US005512980A

United States Patent [19]

Yamaguchi et al.

[11] Patent Number: 5,512,980

[45] Date of Patent: Apr. 30, 1996

[54] METHOD OF AND APPARATUS FOR DETECTING TONER EMPTY

[75] Inventors: Yoshio Yamaguchi; Toshio Tooda, both of Kawasaki, Japan

[73] Assignee: Fujitsu Limited, Kawasaki, Japan

[21] Appl. No.: 300,349

[22] Filed: Sep. 2, 1994

[30] Foreign Application Priority Data

Oct. 22, 1993 [JP] Japan ..... 5-287654

[51] Int. Cl.[6] ..... G03G 15/06

[52] U.S. Cl. ..... 355/206; 355/245; 355/260; 118/688

[58] Field of Search ..... 355/206, 245, 355/260, 209, 207; 118/688, 689, 691

[56] References Cited

U.S. PATENT DOCUMENTS

| | | | |
|---|---|---|---|
| 4,682,874 | 7/1987 | Fantuzzo . | |
| 4,987,449 | 1/1991 | Katoh | 355/206 |
| 4,989,754 | 2/1991 | Grasso et al. | 222/39 |
| 5,142,332 | 8/1992 | Osawa et al. | 355/208 |
| 5,204,698 | 4/1993 | LeSueur et al. | 355/208 X |
| 5,214,475 | 5/1993 | Ishii et al. | 355/206 X |
| 5,287,151 | 2/1994 | Sugiyama | 355/260 |
| 5,331,377 | 7/1994 | Matsuura et al. | 355/208 |
| 5,374,977 | 12/1994 | Shiina et al. | 355/206 |

*Primary Examiner*—R. L. Moses

*Attorney, Agent, or Firm*—Armstrong, Westerman, Hattori, McLeland & Naughton

[57] ABSTRACT

Disclosed are a toner empty detecting method of and a toner empty detecting apparatus for detecting an empty state of toners in a toner hopper. The toner empty detecting method comprises: a step of taking in the output of the detecting element with every constant period; a step of comparing a detected value relative to a take-in value with an average value of the detected values during a detection period of last time; a step of counting the number of times when the detected value is smaller than the average value during a detection cycle of this time; and a step of generating a toner empty output when the count value is larger than the predetermined value. The toner empty detecting apparatus comprises: a toner sensor for detecting the toners in the toner hopper; and a control circuit for comparing a detected value relative to a take-in value when taking in an output of the toner sensor with every constant period with an average value of the detected values during a detection period of last time, comparing the count value with a predetermined value and generating an empty output when the count value is larger than the predetermined value. Even if there is a scatter in output level of the toner detection sensor, the toner empty can be thereby stably detected.

29 Claims, 18 Drawing Sheets

FIG.16A
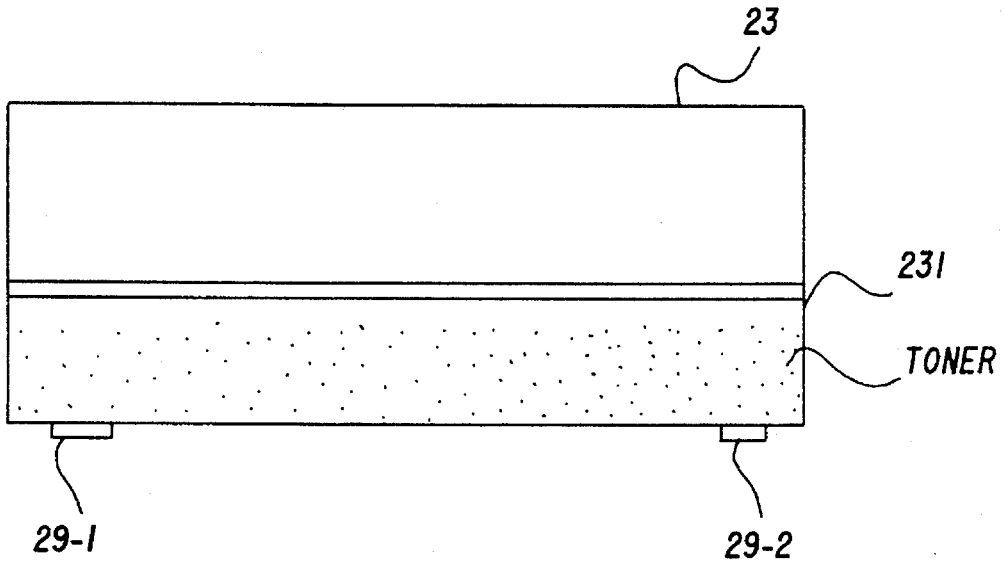
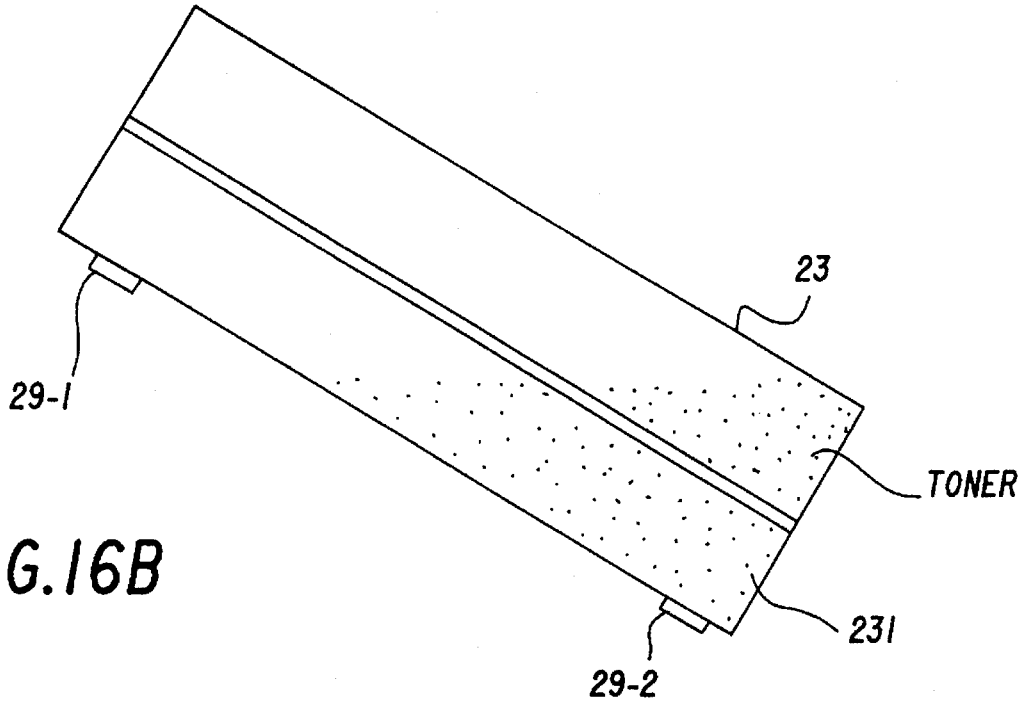
FIG.16B

FIG.17A
PRIOR ART
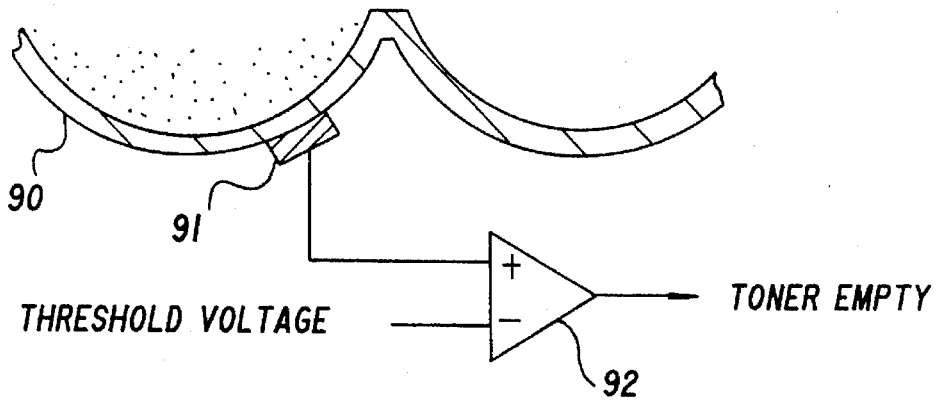
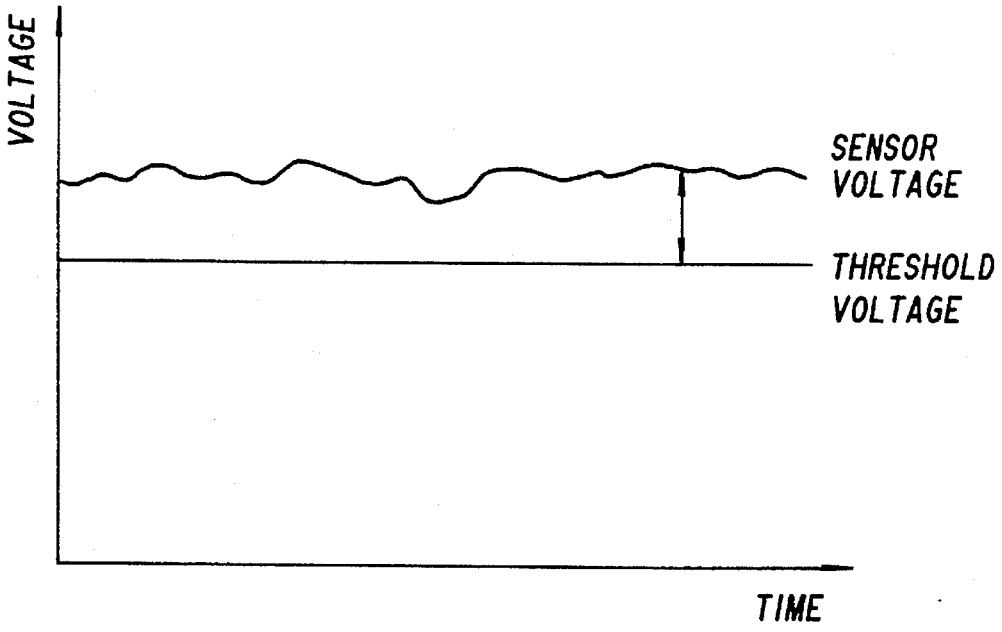
FIG.17B
PRIOR ART

METHOD OF AND APPARATUS FOR DETECTING TONER EMPTY

BACKGROUND OF THE INVENTION

1. Field of the Invention

The present invention relates to a method of and an apparatus for detecting a toner-empty state in a developing unit.

2. Description of the Related Art

In an image-forming apparatus such as a copying machine, a printer, a facsimile, etc., a latent image forming apparatus, like an electrophotographic apparatus, has been utilized from a demand for recording on ordinary paper. In such an image-forming apparatus, an electrostatic latent image is formed on a photosensitive drum. Thereafter, the electrostatic latent image on the photosensitive drum is developed with a powder developer and is, thereby, transformed into a visible image. Further, after the powder-developed image on the photosensitive drum has been transferred onto a sheet, this sheet is separated from the drum, and the powder-developed image on the sheet is fixed.

In this developing step, the photosensitive drum is supplied with a developer composed of carriers and toners or a developer composed of only toners. With this processing, the toners existing in an interior of the developing unit are consumed. When the toners in the interior of the developing unit are totally consumed up, the developing process cannot continue. For this reason, it is required that an internal toner-empty state be detected.

FIGS. 17A and 17B are explanatory diagrams of the prior art. FIG. 18 is a characteristic diagram of a sensor output. As illustrated in FIG. 17A, according to a conventional toner-empty detecting mechanism, a toner sensor 91 is attached to a toner hopper 90 for housing the toners in the developing unit. This toner sensor 91 generates a voltage output corresponding to a toner quantity. Provided further is a comparator 92 for comparing a detected voltage with a threshold voltage. As shown in FIG. 17B, this comparator 92 compares the detected voltage (sensor voltage) with the threshold voltage and, when the detected voltage comes to the threshold voltage or under, outputs a toner-empty signal.

This toner sensor 91 involves the use of, e.g., a magnetic permeability sensor for detecting magnetic toners. In this sensor 91, as illustrated in FIG. 18, when a toner quantity is small, a sensor voltage is set to exhibit a linear characteristic corresponding to the toner quantity. Hence, in the case of the toner quantity being small, the above toner-empty state can be detected.

The output voltage of the toner detecting sensor is, however, on the order of 5 V at most. Accordingly, there is a scatter in terms of the output voltage of the toner detecting sensor, and, therefore, a conventional method based on a fixed threshold voltage is incapable of detecting the toner-empty state with an accuracy. Especially when the toner detecting sensor is mounted on the side of the apparatus with the developing unit being detachably attached, the output voltage becomes still smaller, and hence a greater influence is on the output voltage.

SUMMARY OF THE INVENTION

It is a primary object of the present invention to provide a toner empty detecting method of, and a toner-empty detecting apparatus for, stably detecting a toner empty condition even when there is a scatter in terms of output level of a toner detecting sensor.

To accomplish this object, according to one aspect of the present invention, there is provided a method for detecting a toner-empty condition from an output of a detecting element for detecting toners in a toner hopper, the method comprising: a step of inputting the output of the detecting element for every constant period; a step of comparing a detected value relative to the input value with an average value of the detected value during a prior detection cycle; a step of counting the number of times the detected value is smaller than the average value during the detection cycle of such prior period; and a step of generating a toner-empty output signal when the count value is larger than a predetermined value after comparing the count value with the predetermined value.

According to another aspect of the present invention, there is provided a toner-empty detecting apparatus for detecting an toner-empty condition in a toner hopper, the apparatus comprising: a detecting element for detecting the toners in the toner hopper; and a control circuit for comparing a detected value relative to an input value when taking in an output of the detectint element for every constant period with an average value of the detected value during a detection. cycle of last time, comparing the count value with a predetermined value and generating an empty output when the count value is larger than the predetermined value.

According to the present invention, the output value of the detecting element is compared with the average value of the detected value during the prior detection cycle, thereby detecting the toner empty condition at a relative level. With this processing, there is eliminated an influence caused by a scatter in terms of the output voltage of the toner detecting element. If constructed in this manner, the empty signal occurs even in the caseof a normal reduction in toner quantity. Accordingly, there is counted the number of times when the input value during the predetermined detection period is smaller than the average value, and the count value is compared with the predetermined value. If the count value is larger than the predetermined value, the empty output signal is generated. with this operation, it is possible to accurately detect an empty condition of even toners which fluctuate during stirring.

Other features and advantages of the present invention will become readily apparent from the following description taken in conjunction with the accompanying drawings.

BRIEF DESCRIPTION OF THE DRAWINGS

The accompanying drawings, which are incorporated in and constitute a part of the specification, illustrate presently preferred embodiments of the invention, and together with the general description given above and the detailed description of the preferred embodiments given below, serve to explain the principle of the invention, in which:

FIGS. 16A and 16B are views showing another embodiment of the present invention;

FIGS. 17A and 17B are views assisting in explaining the prior art; and

DETAILED DESCRIPTION OF THE PREFERRED EMBODIMENTS

Figure 1:
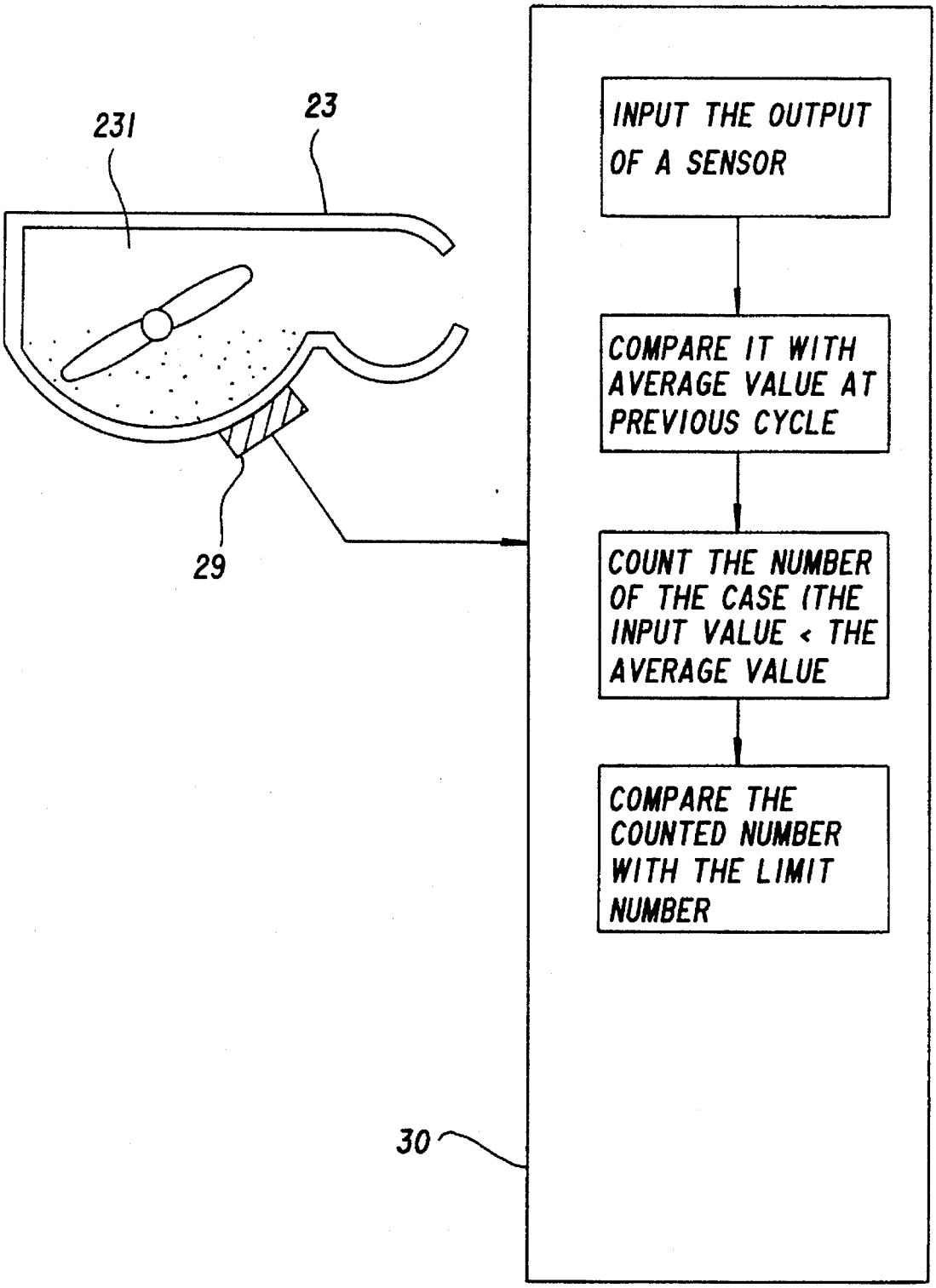
FIG. 1 is a view showing the principle of the present invention.

FIG. 1 is a view showing a principle of the present invention.

As illustrated in FIG. 1, a toner sensor 29 is attached to a toner hopper 231 of a developing unit 23. The toner sensor 29 is constructed of a magnetic permeability sensor. An output of this toner sensor 29 is inputted to a control circuit 30. The control circuit 30 takes in the output of the toner sensor 29 for a predetermined period. Then, the control circuit 30 compares an output value of the toner sensor with an average value during the prior detection cycle. A toner empty state is thereby detected at a relative level. If done in this manner, the empty state is reached even in the case of a normal decrease in toner quantity. For this reason, the control circuit 30 counts the number of times an input value during a predetermined detection cycle is smaller than the average value Then, the control circuit 30 compares the count value with a predetermined value and, when the count value is greater than the predetermined value, generates an empty output signal. With such processing, the empty state of even toners which fluctuate when stirred can be accurately deflected.

Figure 2:
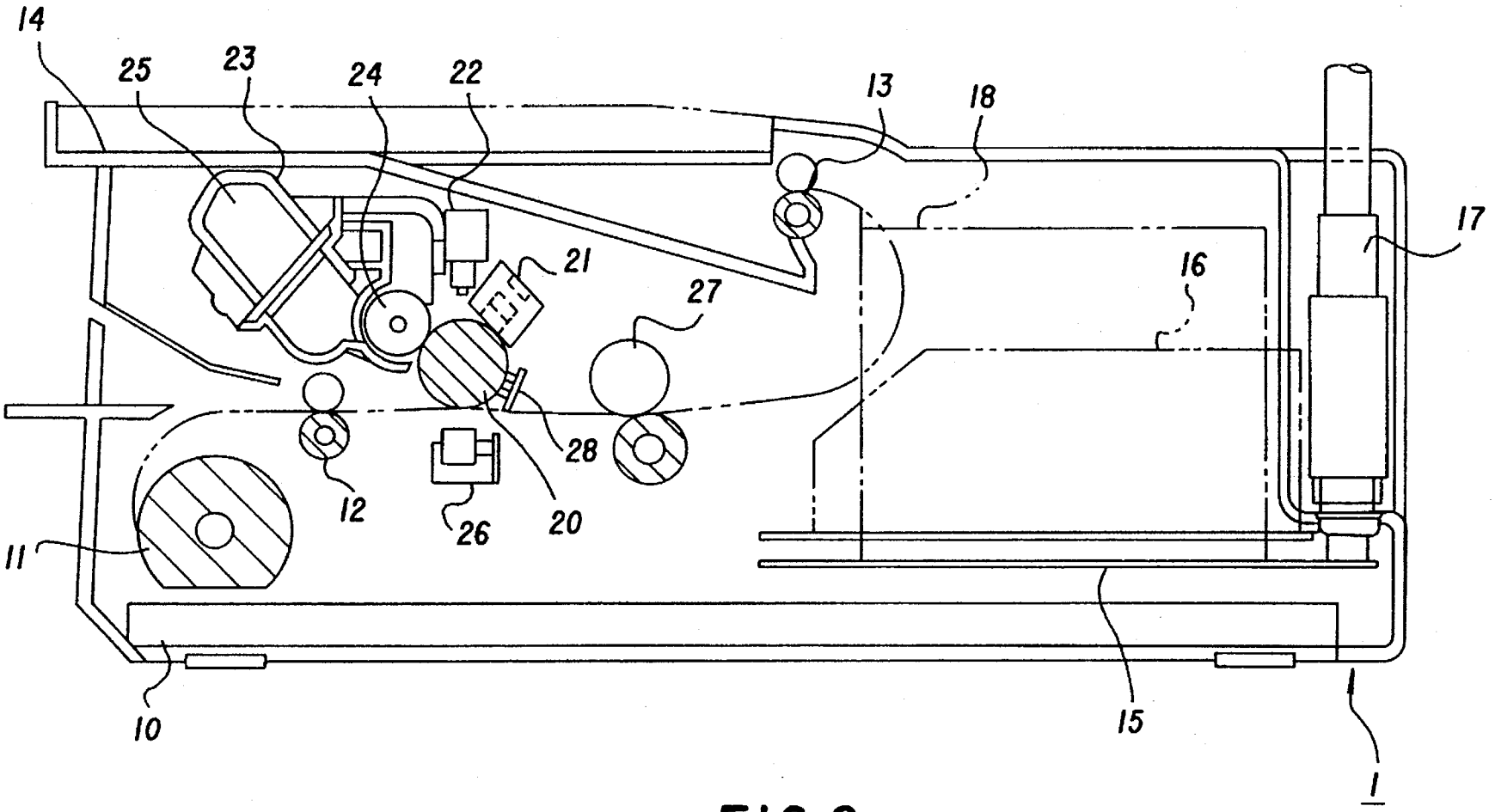
FIG. 2 is a view showing a construction of an image forming apparatus for one embodiment of the present invention.
Figure 3:
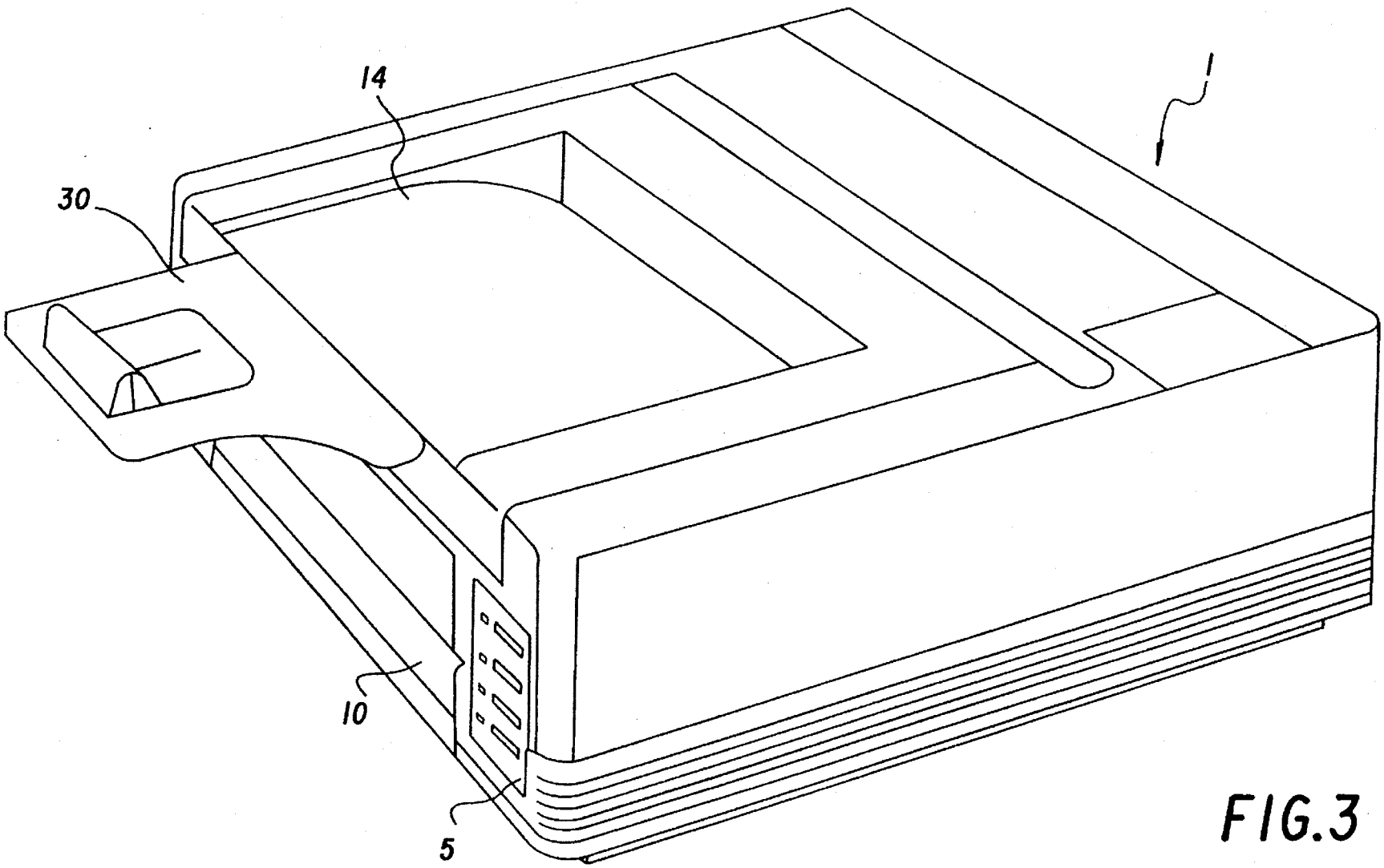
FIG. 3 is a view illustrating a state where the apparatus of FIG. 2 is horizontally installed.
Figure 4:
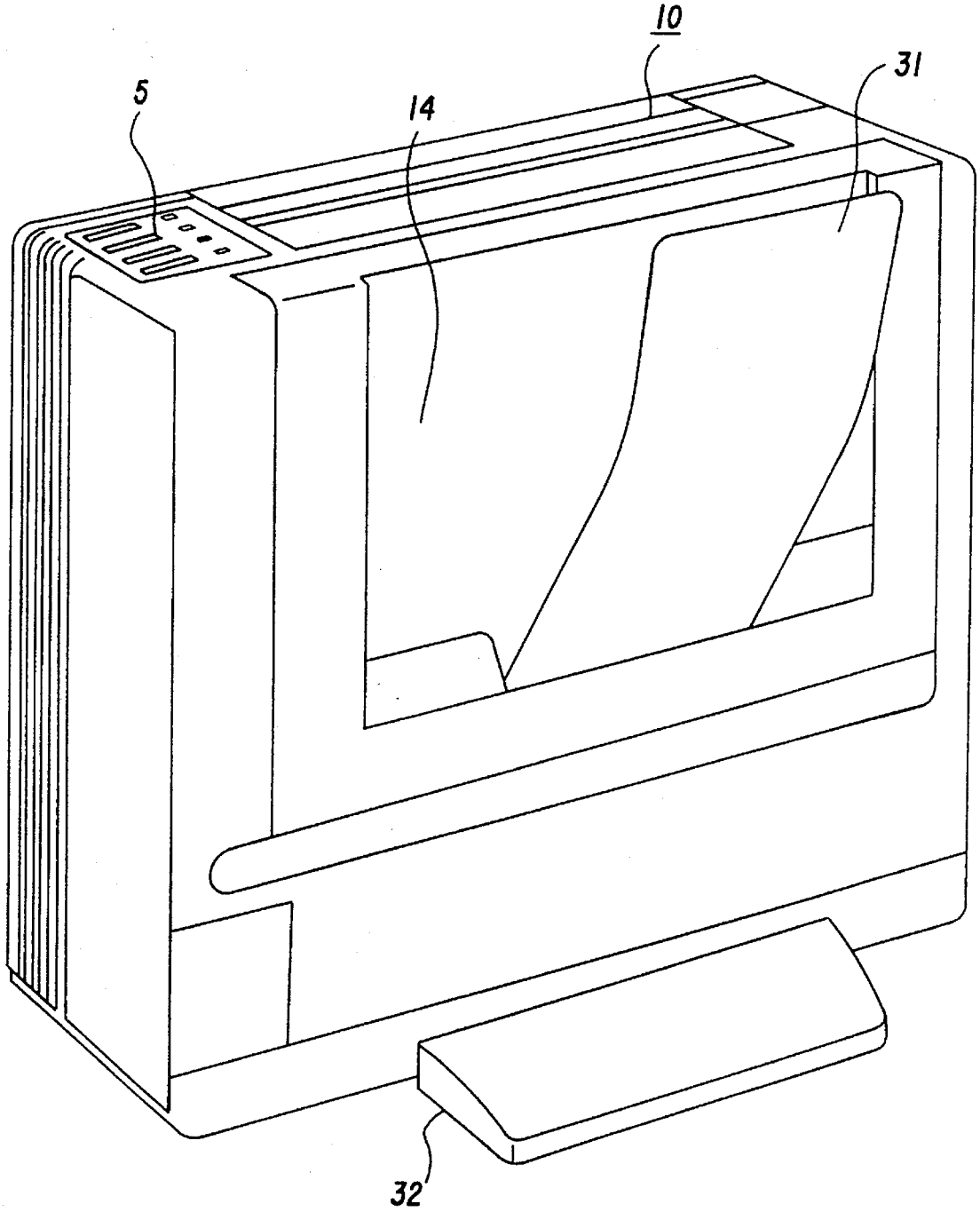
FIG. 4 is a view illustrating a state where the apparatus of FIG. 2 is vertically installed.

FIG. 2 is a view illustrating a construction of an image-forming apparatus in accordance with one embodiment of this invention. FIG. 3 is a view showing a state where the apparatus of FIG. 2 is horizontally installed. FIG. 4 is a view showing a state where the apparatus of FIG. 2 is vertically installed. These figures show a cleanerless electrophotographic printer.

Referring to FIG. 2, a photosensitive drum 20 is constructed such that a functional separation type organic photosensitive body is coated about 26 microns thick on an aluminum drum. Then, the photosensitive drum 20 having a major diameter of 24 mm rotates counterclockwise at a peripheral speed of 25 mm/s. A precharger 21 is a non-contact type charger constructed of a Scolotron. This precharger 21 uniformly charges the surface of the photosensitive drum 20. The precharger 21 charges the surface of the photosensitive drum 20 with −650 V.

An optical unit 22 performs an image-exposure on the uniformly charged photosensitive drum 20, thereby forming an electrostatic latent image on the photosensitive drum 20. This optical unit 22 involves the use of an LED optical system composed of a combination of an LED array and self-focus lenses. This optical unit 22 effects an image-exposure on the photosensitive drum 20 in accordance with an image pattern, thereby forming an electrostatic latent image of −50 to −100 V on the photosensitive drum 20.

Figure 5:
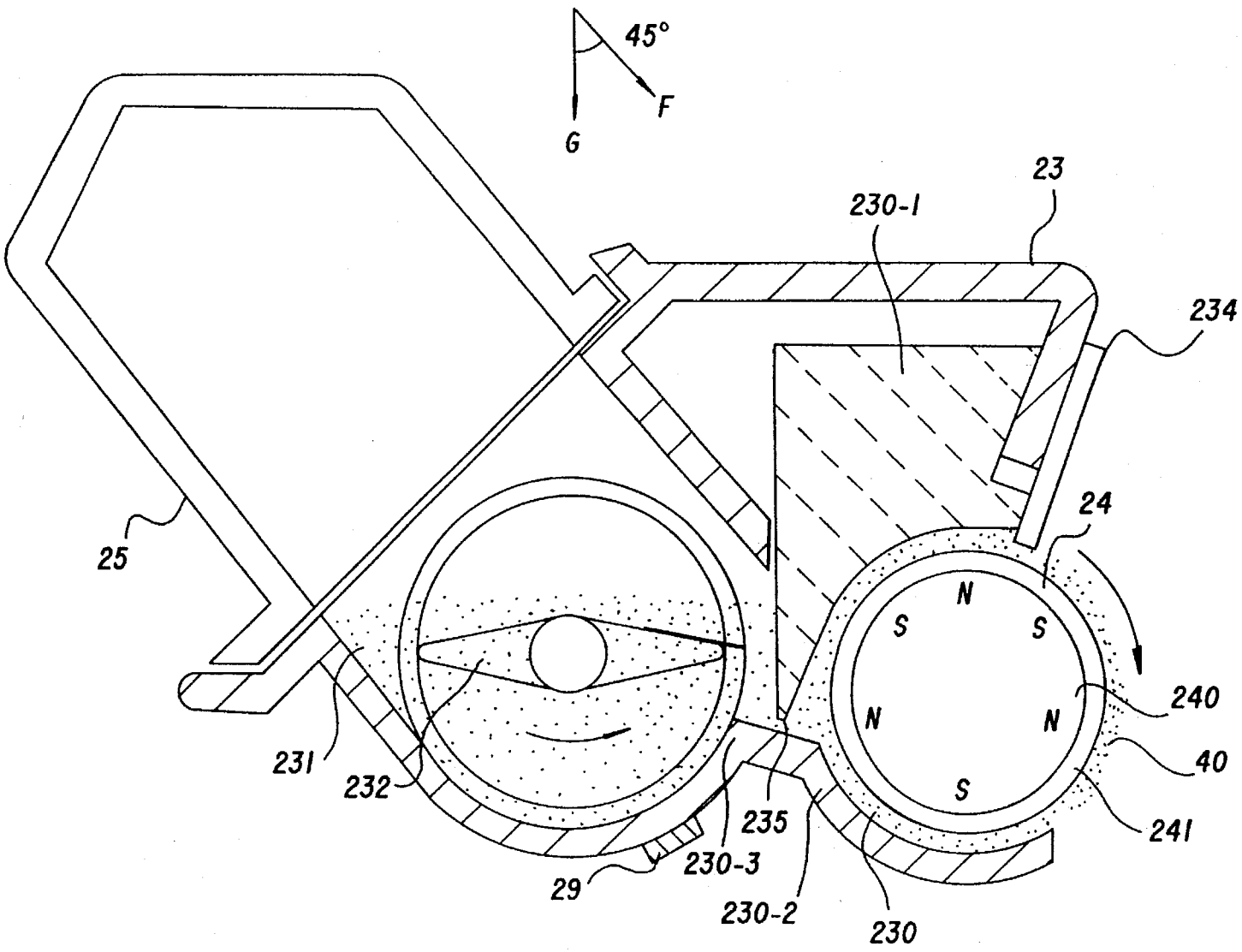
FIG. 5 is a view showing a configuration of a developing unit of FIG. 2.

A developing unit 23 supplies a developer composed of magnetic carriers and magnetic toners to the electrostatic latent image on the photosensitive drum 20 and thus transforms it into a visible image as will be stated referring to figures subsequent to FIG. 5 inclusive. A developing roller 24 feeds the developer to the photosensitive drum 20. A toner cartridge 25 is filled with the magnetic toners and exchangeably attached to the developing unit 23. This toner cartridge 25 is replaced when empty to replenish the developing unit 23 with the magnetic toners.

A transfer unit 26 is constructed of a corona discharger. This transfer unit 26 electrostatically transfers the toner image formed on the photosensitive drum 20 onto a sheet. Then, a voltage on the order of +5 kV to +10 kV is applied to a corona wire from a power supply, thereby generating an electric charge through the corona discharging. A rear surface of the sheet is thus charged to transfer the toner image on the photosensitive drum 20 onto the sheet. The power supply is desirably a constant-current power supply capable of reducing a drop of a transfer efficiency depending on environments by supplying the sheet with a fixed amount of electric charges.

A fixing unit 27 heat-fixes the toner image on the sheet and is constructed of a heat. roller incorporating a halogen lamp serving as a heating source and a pressurizing roller (a back-up roller). Then, the sheet is heated up, thereby fixing the toner image onto the sheet.

A dispersion (uniformizing) member 28 is constructed of a conductive member. This dispersion brush 28 contacts the photosensitive drum 20 and thereby disperses the toners left concentratedly on the photosensitive drum 20. With this dispersion, the toners in the developing unit 23 can be easily collected.

A sheet cassette 10 houses the sheets and is detachably attached to the apparatus. This sheet cassette 10, provided in a lower portion of the apparatus, is attachable to, and detachable from, the front surface of the apparatus, i.e., from the left side in the figure. Pickup rollers 11 pick up the sheet in the sheet cassette 10. Resist rollers 12 align the leading edge of the sheet when the sheet collides therewith. The sheet is thus fed to transferring unit 26. Sheet eject rollers 13 eject the image-fixed sheet into a stacker 14. The stacker 14 mounted on the upper surface of the apparatus stacks the ejected sheets.

A printed circuit board 15 is mounted with a control circuit of the apparatus. A power supply 16 supplies respective elements of the apparatus with electric power. An I/F connector 17 connected to an outside cable is inserted into the apparatus. The I/F connector 17 is connected to a connector of the printed circuit board 15. An option board 18 is mounted with a different type of emulator circuit, a font memory, etc.

The operation of this embodiment will be explained. The Scolotron charger 21 uniformly charges the surface of the photosensitive drum 20 with −650V, and, thereafter, the image exposure is effected by the LED optical system 22. With this processing, the photosensitive drum 20 is formed with an electrostatic latent image with a background area on the order of −650V and a print area on the order of −50 to −100 V.

A developing bias voltage (−300V) is applied to sleeves of the developing rollers 24 of the developing unit 23. Therefore, this electrostatic latent image is developed with magnetic polymerization toners minus-charged beforehand by stirring with the magnetic carriers in the developing unit 23. The electrostatic latent image thus turns out a toner image.

On the other hand, the sheet is picked by the pick rollers 11 out of the sheet cassette 10. The leading edge of the sheet is aligned by the resist rollers 12, and the sheet is then fed toward the transferring unit 26. Subsequently, the toner image on the photosensitive drum 20 is transferred onto the sheet by dint of the electrostatic force. This sheet toner image is fixed onto the sheet by the fixing unit 27. The sheet passes via a U-shaped feeding path and is ejected into the stacker 14 by means of the sheet eject rollers 13.

The residual toners on the photosensitive drum 20, after the transfer, are dispersed by the dispersion member and, besides, the residual electric charges are eliminated. Then, the residual toners on the photosensitive drum 20 pass through the LED optical system as well as through the Scolotron charger 21 and reach the developing unit 23. Then, the residual toners are collected simultaneously with a next developing process. The collected toners are reused in the developing unit 23.

The cleanerless process is used in this embodiment. That is, the transfer efficiency of the developer onto the sheet is not 100%, and, therefore, some toners (developer) are left on the photosensitive drum. For this reason, it is required that the residual toners be eliminated. It is not, however, preferable to provide a cleaner for eliminating the residual toners. Namely, a method of eliminating the residual toners by the cleaner requires a mechanism for reserving the eliminated toners, resulting in a scale-up of the apparatus. Further, the eliminated toners do not contribute to printing, and hence this is not profitable. Moreover, a disposal of the toners may become an issue in terms of the environment.

In this cleanerless process, the developing unit 23 collects the residual toners. Then, with a toner dispersion by the dispersion brush 28, the toners concentrated on one area are dispersed. With this operation, a toner quantity per unit area is reduced to facilitate the collec.tion by the developing unit 23. This toner dispersion exhibits such advantages as to restrain the action of filtering a shower of ions in the corona charger 21 and to make uniform the charged electric potential. Additional advantages are that the action of filtering the exposure in the image-exposing process is restrained, and the image is properly exposed on the photosensitive drum 20.

A point of this recording process is that the toners on the photosensitive drum 20 are collected simultaneously with the developing process. Given below is an explanation of an operation in which the photosensitive body 20 is minus-charged, and the toners are also minus-charged. A surface potential of the photosensitive body 20 is set to −500 through −1000 V by the charger 21. The exposed area with a drop of the electric potential due to the image exposure on the photosensitive drum 20 decreases down to 0 through several 10 V in its electric potential. An electrostatic latent image is thus formed. On the other hand, when developed, a substantially intermediate developing bias voltage (e.g., −300 V) between the surface potential and the latent image potential is applied to the developing rollers 24.

In the developing process, the minus-charged toners adhered onto the developing rollers 24 adhere to the electrostatic latent image on the photosensitive body 20 by an electric field formed by the developing bias voltage and the latent image potential. A toner image is thus formed. In the cleanerless process, simultaneously with this developing process, the transfer residual toners dispersed on the photosensitive drum 20 in the uniformizing process by the dispersion brush 28 are collected by the developing rollers from on the photosensitive body 20 by dint of the electric field formed by the surface potential and the developing bias voltage.

Further, according to the 1.5 component developing method, the magnetic brush contacts the photosensitive drum 20; hence, a mechanical adhesion of the residual toners is decreased by a mechanical sweeping force of the magnetic brush. Besides, there is generated a magnetic attracting force of the residual toners (magnetic toners) and the carriers of the magnetic brush. The collection of the residual toners is thereby facilitated.

High down-sizing of this apparatus can be attained for the reason of having no cleaner, and so on. The apparatus shown in FIG. 2 is 350 mm long, 345 mm wide and 130 mm high, including the sheet cassette 10. Accordingly, the apparatus, as a printer for a personal use, can be readily installed on a disk.

Further, as illustrated in FIG. 3, the apparatus can be horizontally placed with the sheet cassette 10 being horizontal to the installation surface. Referring to FIG. 3, an operation panel 5 is provided on the front surface of the apparatus and is intended to indicate an operation of the apparatus. Further, a sheet guide 30 is provided at the front edge of the stacker 14. This sheet guide 30 has a function to hold the edge of the sheet ejected into the stacker 14 and to align the edge thereof. In accordance with this embodiment, the sheet cassette 10 is attached to, and detached from, the front surface of the apparatus, and the operation panel 5 is also operable. Further, the eject sheets are also ejected from the front surface of the apparatus.

Moreover, as illustrated in FIG. 4, the I/F connector 17 of the apparatus of FIG. 2 ismprovided on the installation surface. The image can be also formed in a state in which the sheet cassette 10 is installed upright so as to be perpendicular to the installation surface. With this arrangement, the installation area can be made smaller than before. At this time, the stacker is provided with a sheet holder 31 for holding the sheet to prevent the sheet from falling when ejected into the stacker 14. Even when installed upright, such falling of the sheet can be prevented. Further, a stand 32 is provided on the installation surface of the apparatus, whereby the apparatus can be stably installed even when installed upright.

Moreover, even by using the cleanerless process, the precharger 1 and the transferring unit 26 are constructed of a non-contact type discharger, and, therefore, the toners on the photosensitive drum 20 are not adhered to these units, with the result that the uniform charging and the transfer are stably executable.

Figure 6:
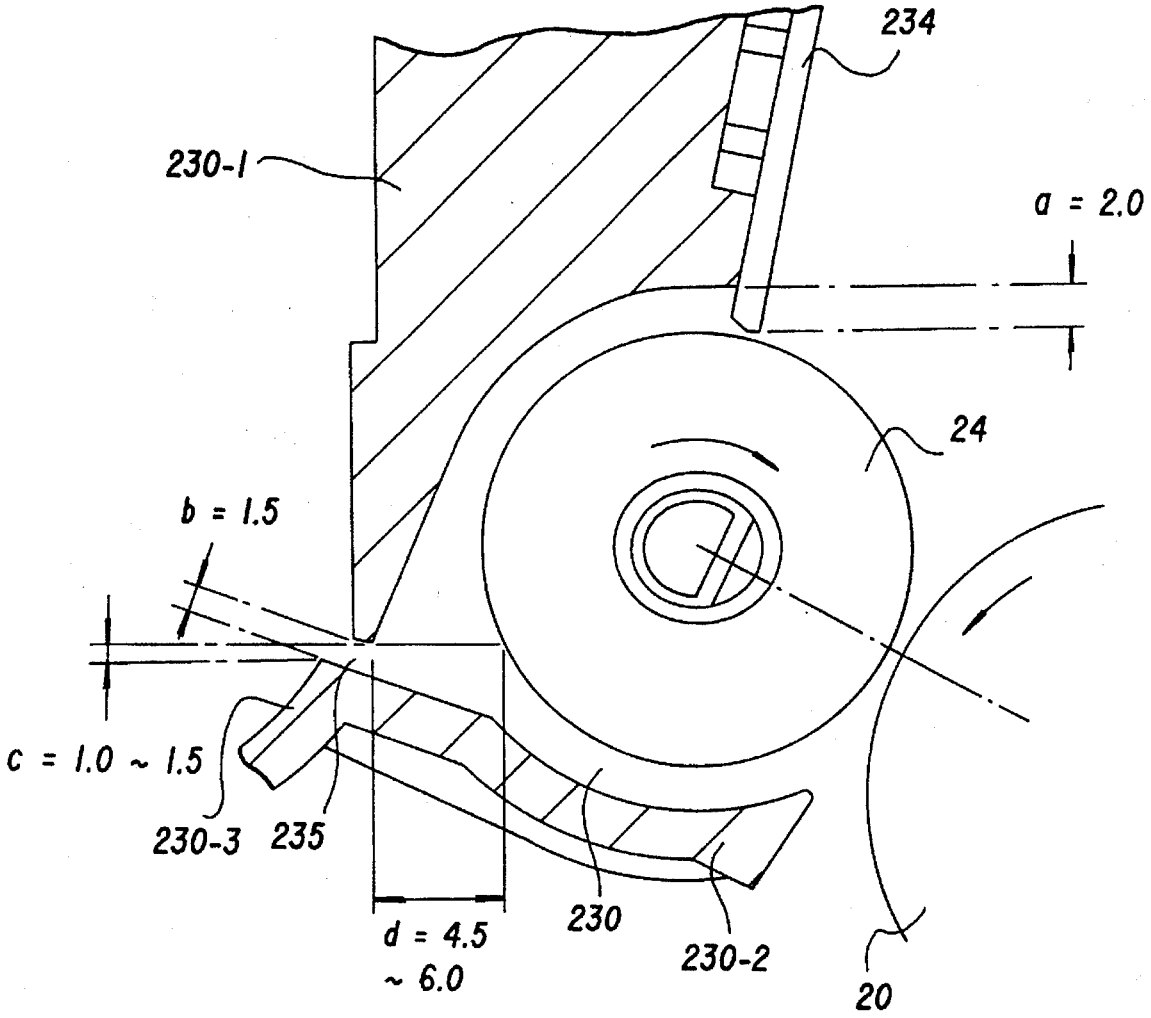
FIG. 6 is a sectional view showing the principal elements of the developing unit of FIG. 5.
Figure 7:
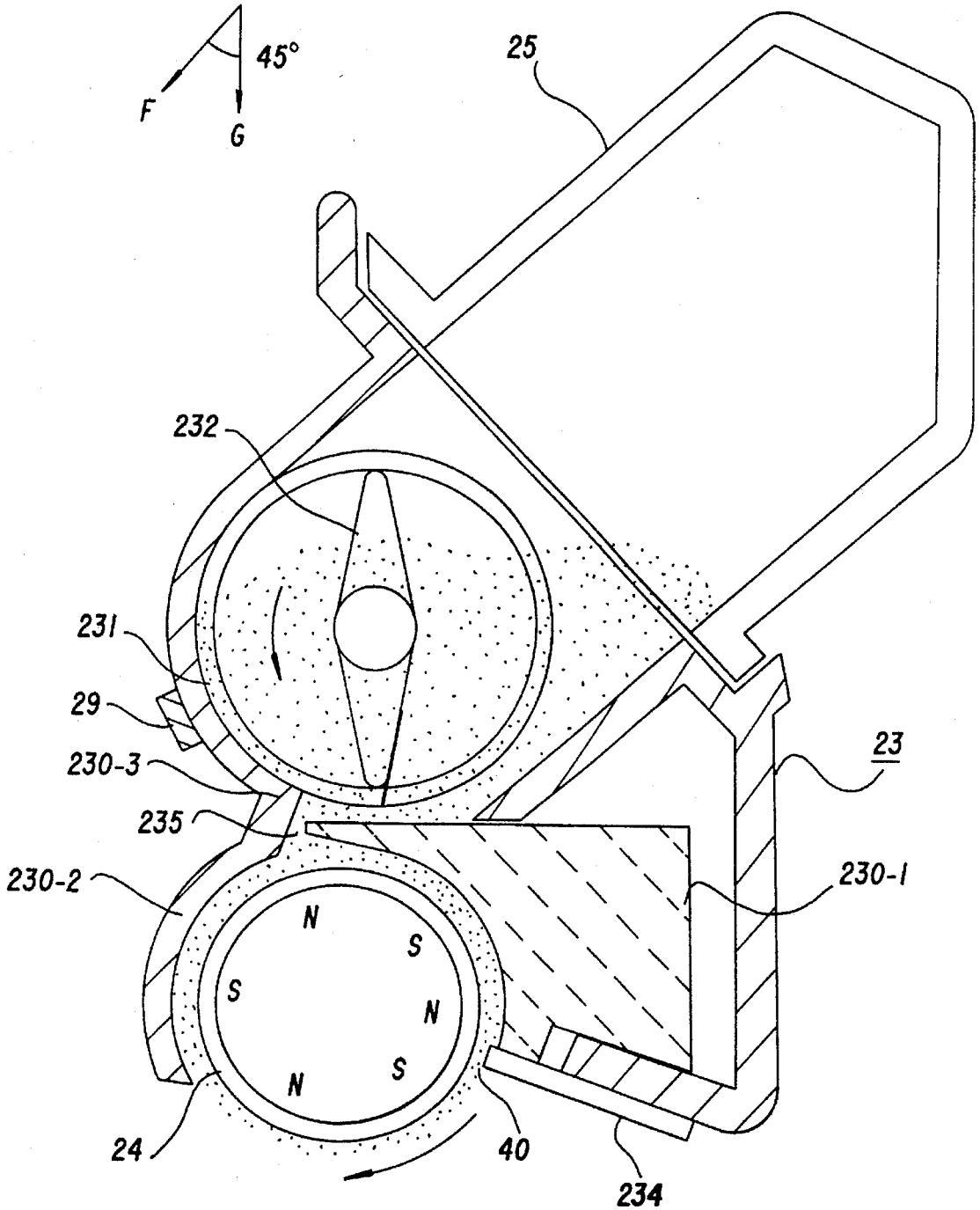
FIG. 7 is a view showing a state where the developing unit of FIG. 5 is vertically installed.
Figure 8A:
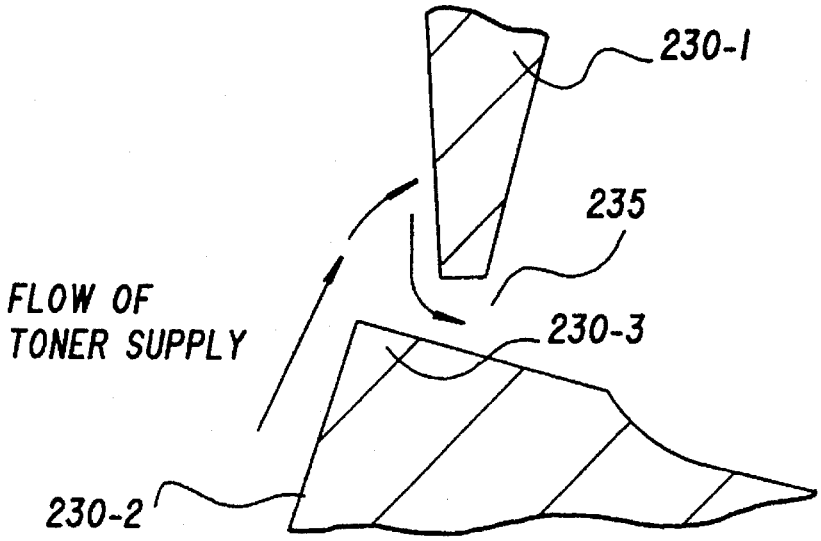
FIGS. 8A and 8B are views assisting in explaining how the developing unit of this invention operates.
Figure 8B:
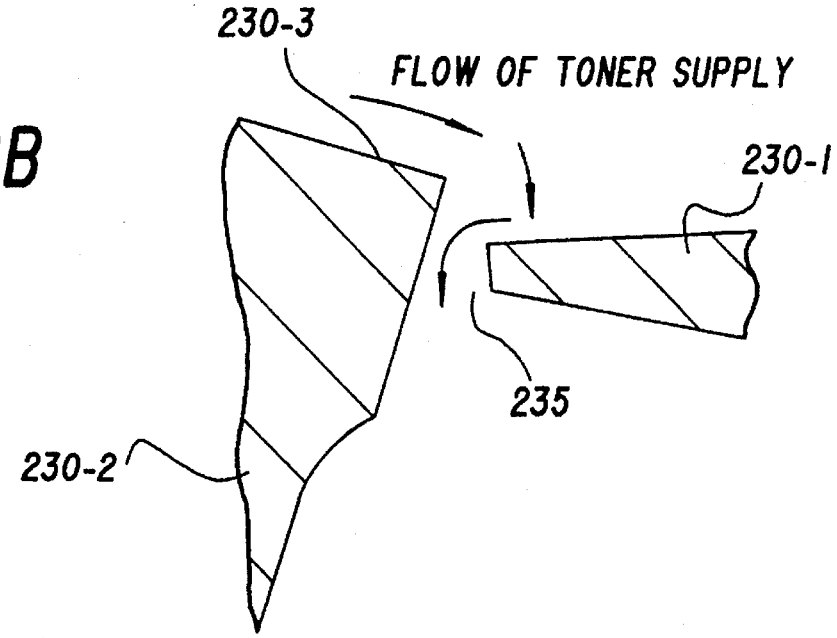
Figure 9:
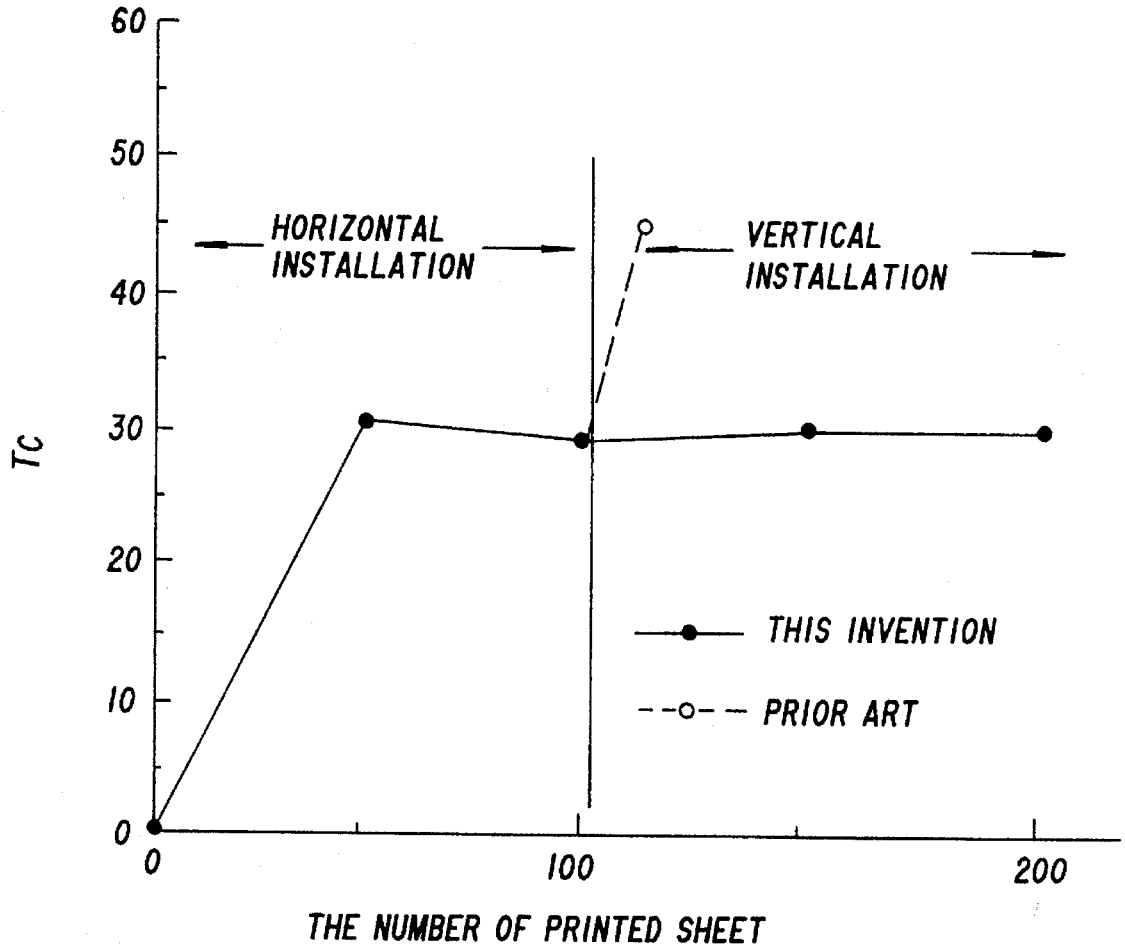
FIG. 9 is a characteristic diagram of a developing operation according to this invention.

FIG. 5 is a view illustrating a configuration of the developing unit of FIG. 2. FIG. 6 is a sectional view showing the principal elements of the developing unit of FIG. 5. FIG. 7 is a view showing a state where the developing unit of FIG. 2 is installed upright. FIGS. 8A and 8B are views of assistance in explaining the operation of how the toners are supplied. FIG. 9 is a characteristic diagram of the developing operation according to this invention.

Referring to FIG. 5, a toner sensor 29 is constructed of a magnetic permeability sensor. This sensor 29 generates a voltage output corresponding to a magnetic force of the magnetic toners. Further, this sensor 29 is mounted on the side of the apparatus. On the other hand, the developing unit 23 is detachably attached. Accordingly, the sensor 29 detects the internal magnetic toners through a case of the developing unit 23.

Next, the developing rollers 24 are constructed of a metal sleeve 241 and a magnet 240 incorporated therein and. having a plurality of magnetic poles. These developing rollers 24 feed a magnetic developer which will be mentioned later with the aid of rotations of the sleeve, while the magnet 240 inside the sleeve 241 is fixed. The developing roller 24 is 16 mm in diameter and rotates three times (75 mm/s) as high as the peripheral speed of the photosensitive drum 20.

A developing chamber 230 is formed along the periphery of the developing roller 24. An interior of the developing chamber 230 is filled with a 1.5-component developer containing a mixture of the magnetic carriers and the magnetic toners. This developing chamber 230 is defined by an upper partition member 230-1 and a lower bottom 230-2 and has a fixed capacity.

Accordingly, when a fixed quantity of magnetic carriers are put into the developing chamber 230, a quantity of the magnetic toners in this developing chamber 230 becomes fixed. For this reason, when the magnetic toners for a consumption are replenished fron a toner hopper 231, the quantity of the developer in this developing unit 230 is fixed and, therefore, a toner density becomes uniform. A necessity for controlling the toner density is thereby eliminated. That is, the developing chamber 230 is charged with the carriers of a quantity corresponding to a control point of the toner density, thereby automatically controlling the toner density in a predetermined range.

Further, this developing chamber 230 is always filled with the developer along the developing roller 24. Accordingly, even if the apparatus is installed upright, it is possible to avoid a situation where the developer in the developing chamber 230 concentrates on one side enough not to supply the developing roller 24 with the developer.

A developer 40 involves the use of a magnetite carrier as a magnetic carrier which has an average particle size on the order of 40 microns and further a magnetic toner having an average particle size of 7 microns and manufactured by the polymerization method. The polymerized toners are of uniform particle size but of distinctive particle size distribution. Hence, in the transfer process, the toner image on the photosensitive drum 20 uniformly adheres to the sheet. For this reason, the electric field in the transfer area becomes uniform. The transfer efficiency can be more enhanced than by the toners based on the conventional pulverizing method. The transfer efficiency of 60– 90% in the pulverized toners is improved to 90% or above in the polymerization toners.

The toner density of these toners is, though 5–60 wt % is proper, set to 25 wt % in this embodiment.

A doctor blade 234 serves to regulate a quantity of the developer supplied by the developing rollers 24 to the photosensitive drum 20 so as not to cause an oversupply or conversely an undersupply to the electrostatic latent image on the photosensitive drum 20. The regulation thereof is performed in a gap between an edge of the doctor blade 234 and the surface of the developing roller 24. Normally, the gap is adjusted to approximately 0.1–1.0 mm.

The toner hopper 231 is filled with only the magnetic toners and includes supply rollers (agitator) 232 inside. The toners are supplied to the developing chamber 230 with rotations of this supply roller 232.

The toners supplied into this developing chamber 230 are stirred in the developing chamber 230 by a developer feeding force and a magnetic force of the developing roller 24 as well as by a developer restricting function of the doctor blade 234. Then, the toners are rubbed against the carriers and thereby charged to a predetermined polarity and with a charging quantity. In accordance with this embodiment, a charging system of the carriers and the toners is adjusted so that the toners are minus-charged.

Further, the gap between the partition member 230-1 and the developing roller 24 is made smaller than a bristle height of the magnetic brush formed on the developing roller on the upstream side of the blade 234. Herein, as shown in FIG. 6, a gap a is set to 2.0 mm. With this setting, the magnetic brush on the developing roller 24 undergoes a regulation by the partition member 230-1 and then receives a force with rotations of the developing roller 24. For this reason, a stirring property of the developer in the developing chamber 230 enhances, thereby making it possible to obtain a stable toner charging quantity even in a range of the high toner density.

Further, a wall surface 230-4 of this partition member 230-1 is formed in a shape along the developing roller 24. Namely, the wall surface 230-4 assumes basically a circular arc at the gap a. Hence, there exists no place where the magnetic carriers stay. Consequently, all the magnetic carriers and magnetic toners are always stirred along the developing rollers 24 and then fed. Accordingly, fluctuations in toner density control value can be prevented.

Moreover, all the magnetic carriers and magnetic toners are stirred, and, therefore, the stable toner charging quantity can be expected even in the range of high toner density. Besides, even when installed horizontally or upright, the charging effect does not change.

Provided between the toner hopper 231 and the developing chamber 230 is a toner supply passage 235 defined by the distal end of the partition member 230-1 and the bottom 230-2. A width b of this toner supply passage 235 is, as shown in FIG. 6, 1.5 mm. The toners of the toner hopper 231 are supplied via this toner passage 235 to the developing chamber 230.

The bottom 230-2 forming this developing chamber 230 includes a projection 230-3 protruding from the toner hopper 231 with respect to the toner supply passage 235. Furthermore, this bottom 230-2 forms an oblique surface extending upward from the photosensitive drum 20. A gap c between the distal end of this projection 230-3 and the distal end of the partition member 230-1 is set, as illustrated in FIG. 6, to 1.0–1.5 mm. That is, the bottom 230-2 is inclined by a quantity corresponding thereto.

Additionally, a gap d between the partition member 230-1 and the wall surface 230-4 is set to 4.5–6.0 mm. In this way, the gap d in the position of the toner supply passage 235 is set larger than the gap a in other position. It is therefore possible to prevent the tip of the magnetic brush from extending into the toner supply passage 235. For this reason, it is feasible to prevent the magnetic carrier in the developing chamber 230 from leaking into the toner supply chamber 231 from the toner supply passage 235. Hence, a reduction in quantity of the magnetic carriers in the developing chamber 230 can be prevented. The toner density control value can be therefore kept to a fixed value. At the same time, the magnetic brush does not become an obstacle against the operation to supply the toners via the toner supply passage 235.

An angle made by two wall surfaces of the toner cartridge 25 and the toner hopper 231 is set at approximately 45 degrees to the direction of gravity. A flowing direction of the toners is set at 45 degrees. With this setting, as will be stated later, even when the apparatus is installed upright, the toners can be smoothly supplied.

Next, the operation of this developing unit will be explained. FIG. 5 illustrates a state of the developing unit when the apparatus shown in FIG. 3 is installed horizontally. The angle made by the wall surfaces of the toner cartridge 25 and the toner hopper 231 is set at about 45 degrees to the direction of gravity. For this reason, the toners flows toward the bottom of the toner hopper 231 and are smoothly supplied to the supply rollers 232.

In this horizontal installation, the toners exhibit a fluidity toward the bottom in the toner hopper 231 because of the gravity. The supply rollers 232 scrape up the toners in the bottom of the toner hopper 231. At this time, as illustrated in FIG. 8A, the toners raised by the supply rollers 232 temporarily collide with the partition member 230-1 via the projection 230-3 of the bottom 230-2 and enter the toner supply passage 235.

Consequently, only the toners for a supply by the toner supply rollers 232 enter the toner supply passage 235. Simultaneously, the relevant portion of the partition member 230-1 serves as a buffer. An intruding force by the toner supply rollers 232 does not exert an influence directly on the toner supply passage 235. Hence, an excessive intrusion of the toners can be prevented, and the developing chamber 230 is replenished with the toners of a quantity for a shortage.

In this case, the bottom 230-2 is tilted upward with respect to the rotating direction of the developing roller 24. Therefore, the magnetic brush of the developing roller 24 after passing through the photosensitive drum 20 and the carriers off the brush do not leak into the toner supply chamber 231 from the toner supply passage 235 via the bottom 230-2. It is therefore feasible to prevent a reduction in the starter carriers of the developing chamber 230, and the stable 1.5-component development is attainable.

On the other hand, in the state of the developing unit where the apparatus shown in FIG. 7 is installed upright as in FIG. 4, the angle made by the wall surfaces of the toner cartridge 25 and of the toner hopper 231 is set at 45 degrees to the direction of gravity. Hence, even when installed upright, the toners can be smoothly supplied to the supply rollers 231.

This angle made by the wall surfaces of the toner cartridge 25 and the toner hopper 231 is, it is proper, set on the order of 45 degrees ±10 degrees to the direction of gravity in consideration of an angle of repose in order to feed the toners well by the self- weight of the toners. A good result will be obtained when set at preferably 45 degrees ±5 degrees.

At this time, as illustrated. in FIG. 7, the toners stay in the toner hopper 231 of the partition member 230-1 and easy to drop down into the developing chamber 230 from the toner supply passage 235. As shown in FIG. 8B, however, the projection 230-3 of the bottom 230-2 restricts the drop-down of the toners from the toner supply passage 235. Consequently, there is almost no falling of the toners. Hence, the supply of the toners depends on the rotating force of the toner supply rollers 232.

That is, as depicted in FIG. 8B, the toners pushed by the supply rollers 232 temporarily collide with the partition member 230-1 through the projection 230-3 of the bottom 230-2 and thus enter the toner supply passage 235. Only the toners for a supply by the toner supply rollers 232 are thereby come into the toner supply passage 235. With this action, the relevant portion of the partition member 230-1 serves as a buffer, and the intruding force by the toner supply roller 232 does not directly become a force for supplying the toners. It is therefore possible to prevent an excessive intrusion of the toners. The developing chamber 230 is replenished with toners of a quantity corresponding to the shortage amount.

This indicates that the capability of supplying the toners to the developing chamber 230 does not change even when the apparatus is installed horizontally or upright. For this reason, even when the apparatus is installed horizontally or upright, the toner density in the developing chamber 230 does not vary, whereby variations in the image density can be prevented.

Further, the upright installation may cause the drop-down of the developer from the developing unit 23. However, the magnetic two-component developer is employed as the developer, and hence the developer adheres to the developing rollers 24 by magnetic force. Consequently, even when installed upright, almost no falling of the developer takes place.

Particularly when using the magnetic carriers and the magnetic toners, both of the carriers and the toners are held by the magnet rollers of the developing rollers 24. Therefore, the falling of the developer can be prevented all the more. Even if such an upright installation is done, stable operation can be attained.

FIG. 9 is a characteristic diagram showing variations in the toner density Tc in the case of producing the print when the apparatus is installed upright (vertically) after the print has been effected with the apparatus installed laterally (horizontally).

First, the apparatus is installed horizontally, and a predetermined amount of start carriers are put into the developing chamber 230 of the developing unit 23. The developing unit is then operated, and the printing process is thus conducted. As a result, the toners are gradually supplied from the developing chamber 230. Hence, the toner density enhances with an increase in the number of printed sheets. Then, just when the developing chamber is full of the carriers and the toners, the toner density is 30 wt %. Thereafter, even when the number of the printed sheets increases, no change in the toner density can be seen.

Next, in this state, the apparatus is changed to the upright installation, and the printing process is thus performed. As a result, the toner density remains the same with the horizontal installation. According to the configuration disclosed in Japanese Patent Laid-Open Publication No.3-252686, as shown by the white circle in the figure, when installed upright, the toner density enhances. The toner density changes depending on the horizontal installation or the upright installation. The image density therefore changes. This implies the stable action. of the above-mentioned toner supply. With this action, the image can be formed with no change in the image density even when the apparatus is installed horizontally or upright. It is possible to actualize the image forming apparatus capable of being installed horizontally and upright as well.

Figure 10:
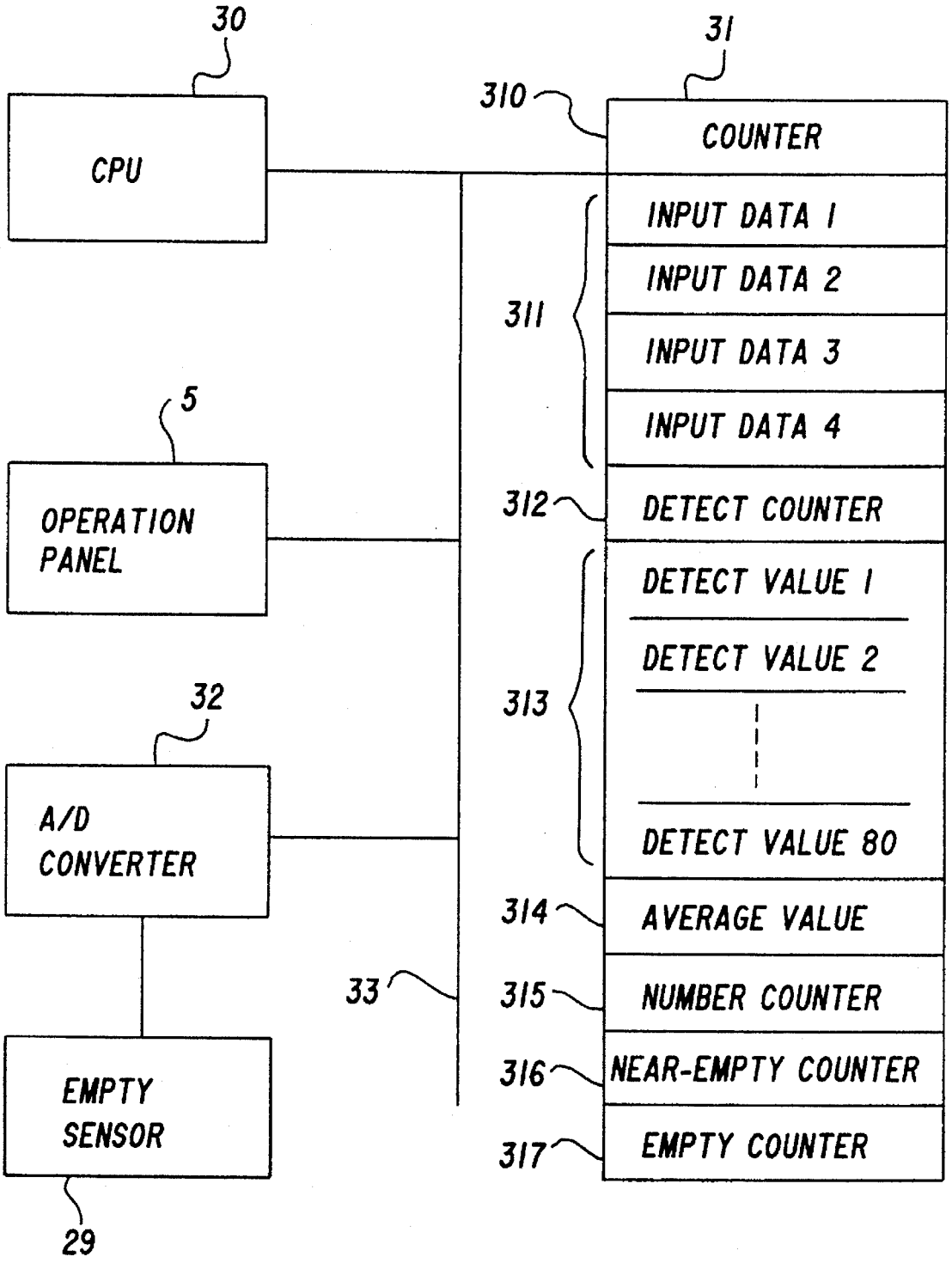
FIG. 10 is a block diagram of one embodiment of this invention.
Figure 11:
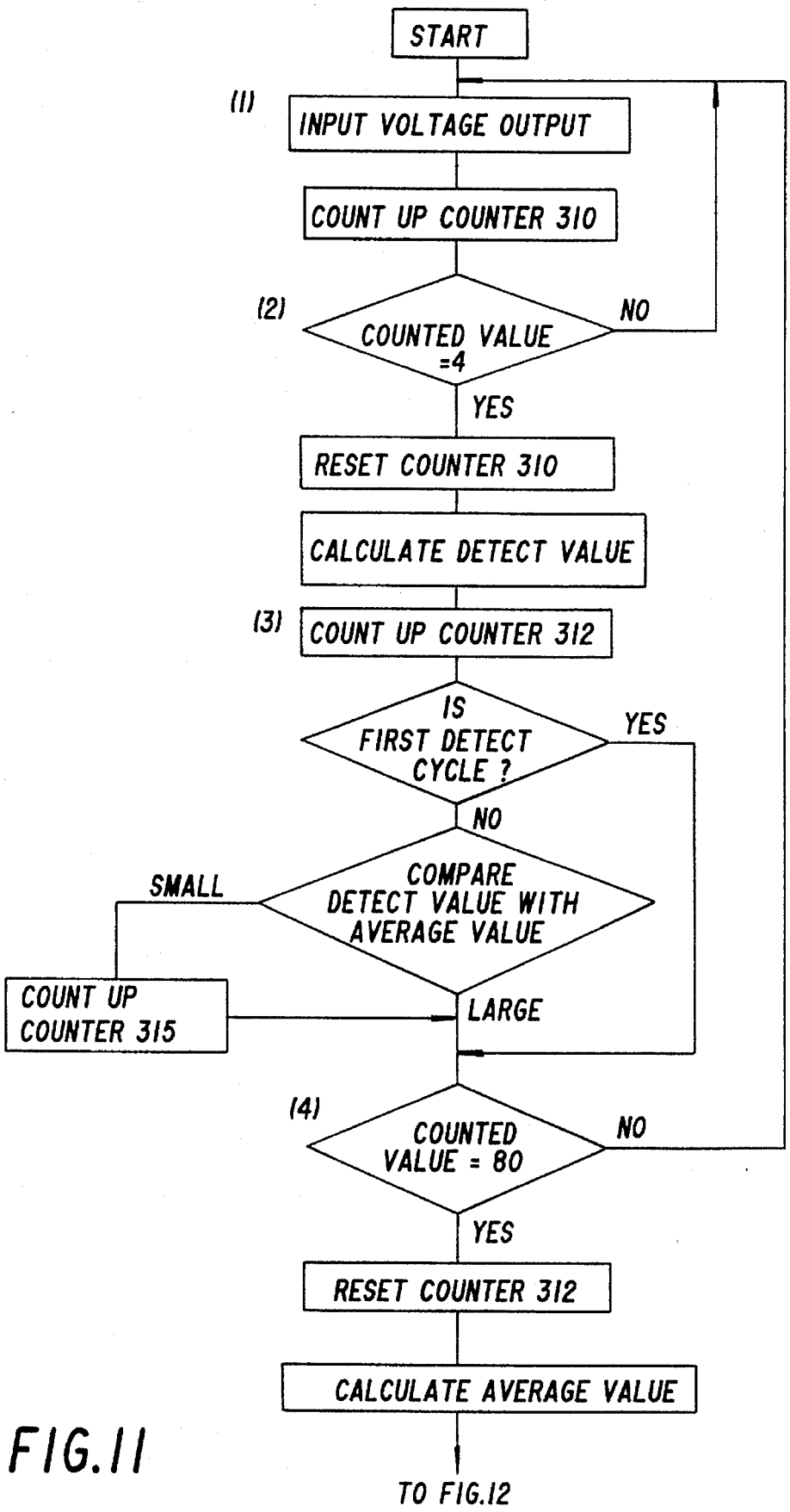
FIGS. 11 and 12 are flowcharts of the detection processing in one embodiment of this invention.
Figure 12:
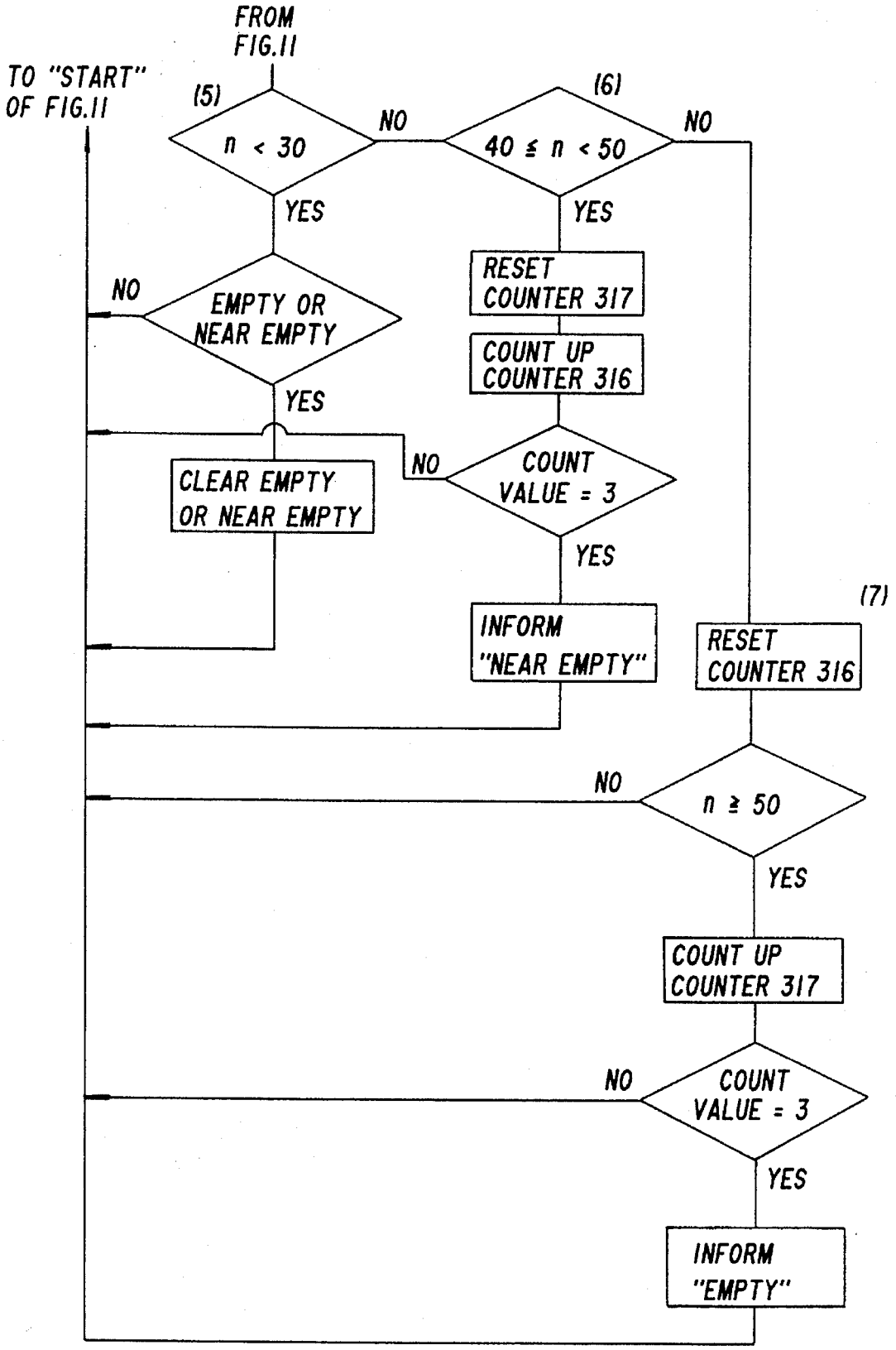
Figure 13:
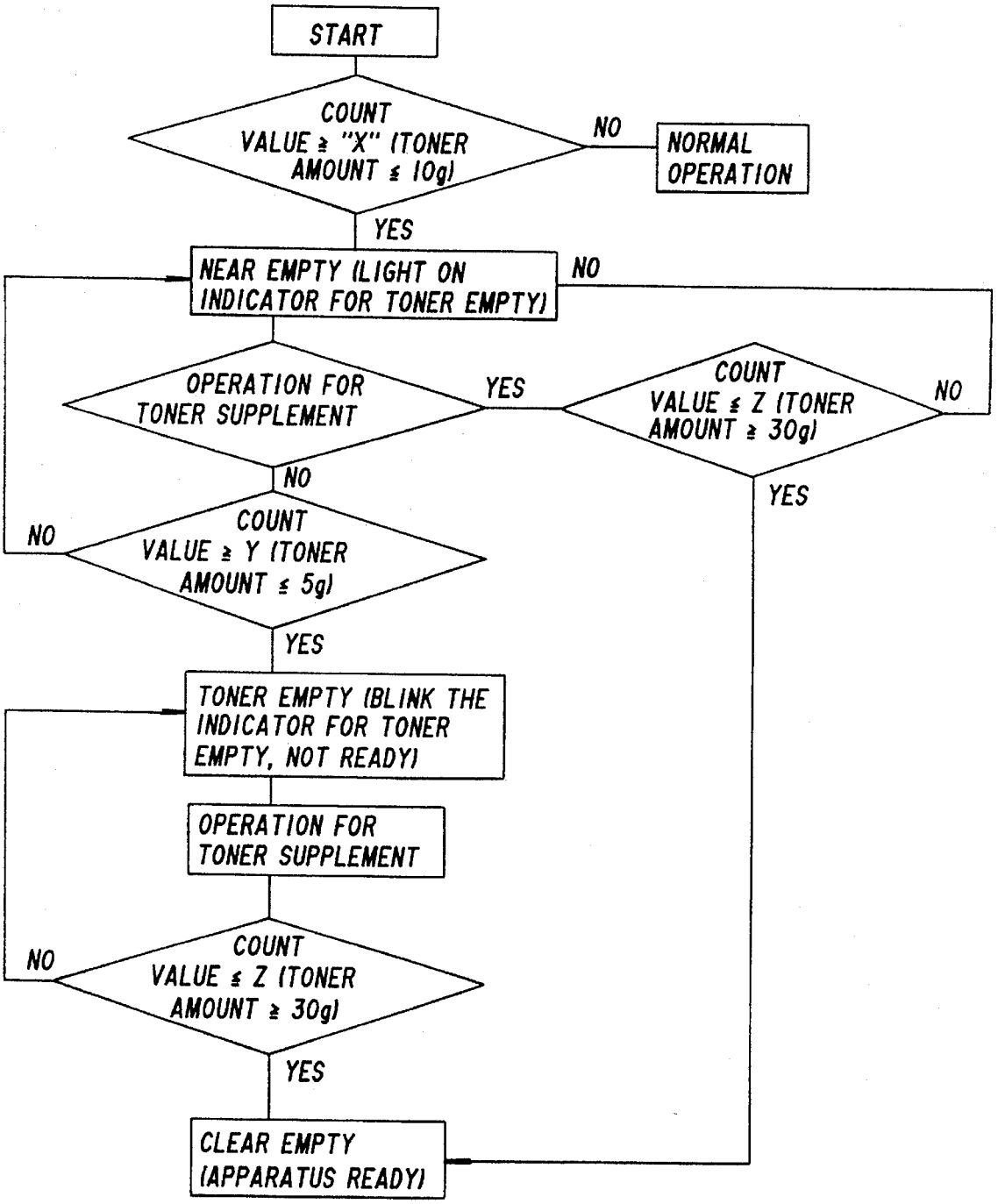
FIG. 13 is a flowchart of the detecting operation in one embodiment of this invention.
Figure 14:
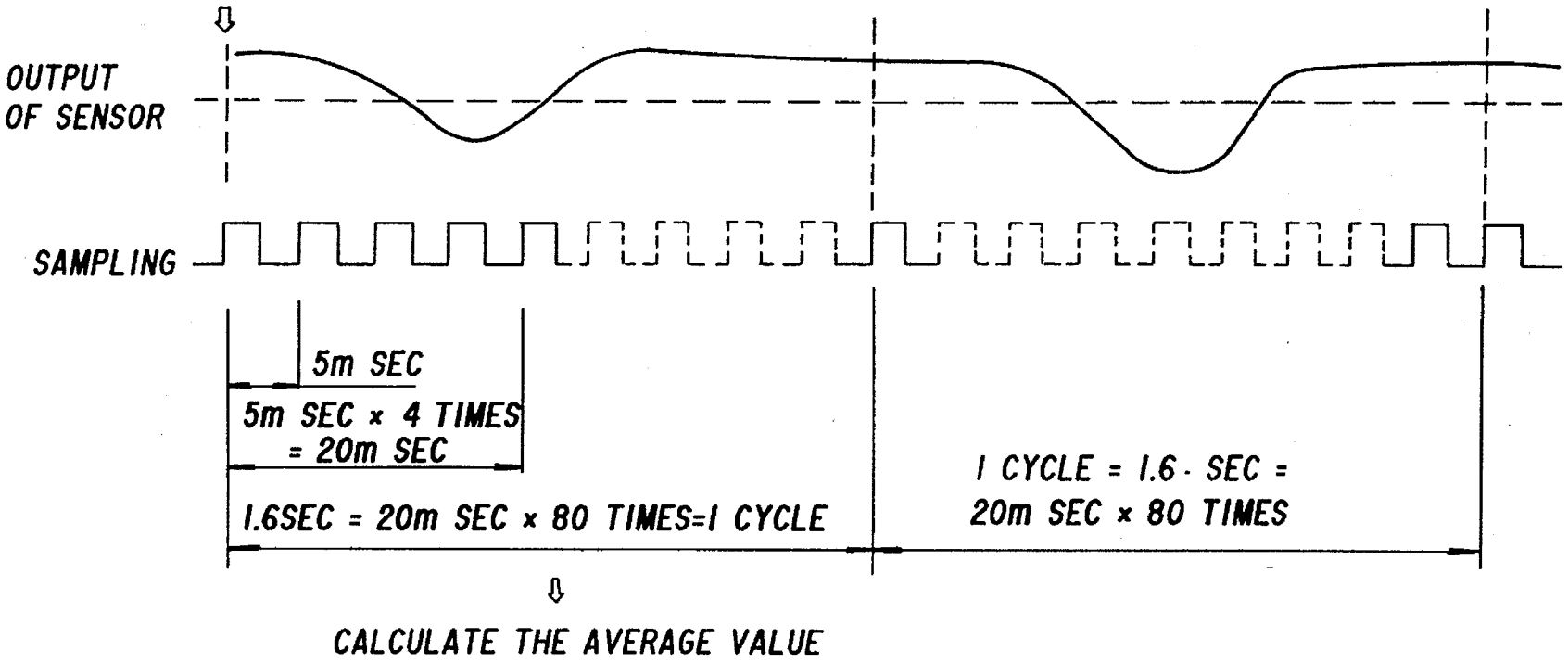
FIG. 14 is a view assisting in explaining the detecting operation in FIGS. 11 and 12.

FIG. 10 is a control block diagram in one embodiment of the present invention. FIGS. 11 and 12 are flowcharts of toner empty detection processing. FIG. 13 is a flowchart of a toner empty operation. FIG. 14 is a view of assistance in explaining the toner empty detecting operation. output versus a toner quantity.

Figure 15:
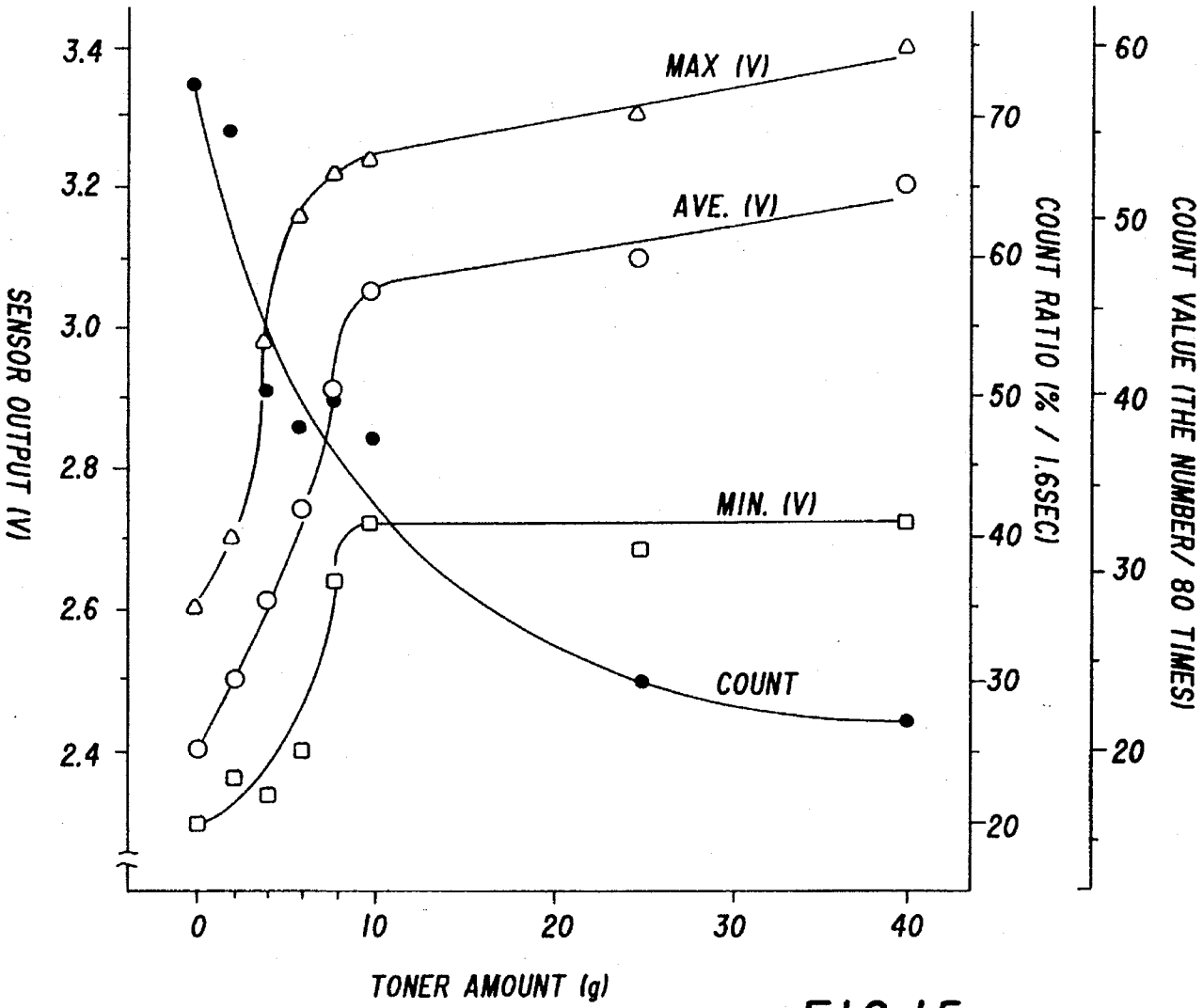
FIG. 15 is a diagram showing a relationship of a toner sensor output versus a toner quantity according to the present invention.
Figure 18:
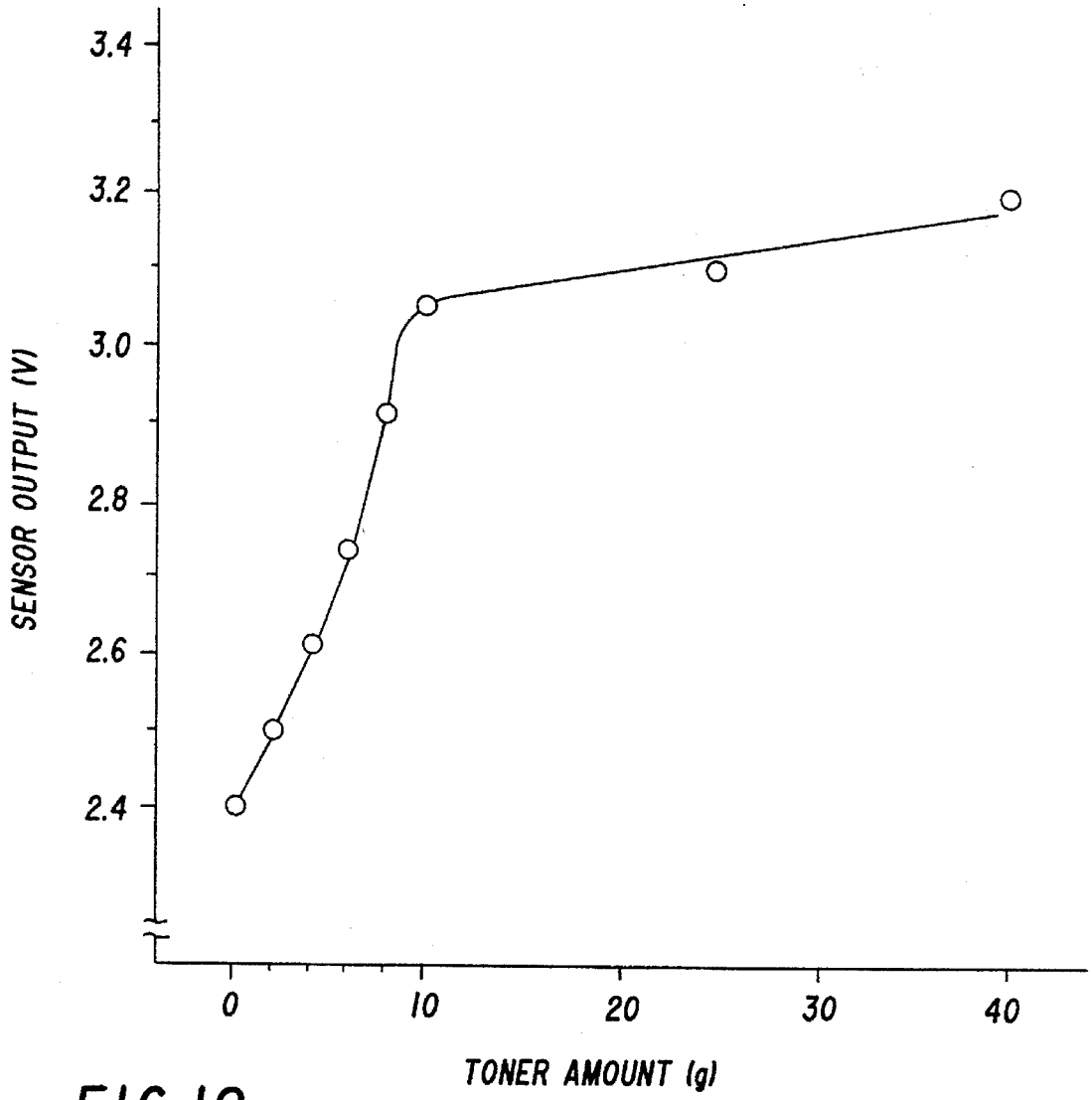
FIG.18 PRIOR ART
FIG. 18 is a characteristic diagram of the toner sensor output.

FIG. 15 is a view showing a relationship of a toner sensor Referring to FIG. 10, a processor 30 is constructed of a microprocessor. This processor 30 controls the respective mechanism units of the printer and, at the same time, controls the toner empty detection. A memory 31 stores respective items of data pertaining to the toner empty detection, etc.

This memory 31 comprises an input counter area 310 for counting the number of input operations of sample data and an area 311 for storing take-in values for 4 times. The memory 31 also comprises a detection counter area 312 for counting the number of detections of detected values for 80 times (one detection cycle) and an area 313 for storing the detected values for 80 times wherein the detected value serves as an average value of the sample data for 4 times. The memory 31 further comprises an average value area 314 for storing an average value of the detected values for 80 times (for one detection cycle) and a number-of-times counter area 315 for counting the number of times when the detected value is smaller than the average value during one detection cycle. The memory 31 still further comprises a near empty counter area 316 for counting the number of times when in a near empty state and an empty counter area 317 for counting the number of times when in a toner empty state.

An A/D (analog/digital) converter 32 converts an analog voltage given from the empty sensor 29 into a digital value. A bus 33 serves to connect the processor 30, the memory 31, the operation panel 5 and the A/D converter 32 to each other, whereby the data are transferred and received therebetween.

Next, a toner empty detecting process will be explained with reference to FIGS. 11 and 12.

(1) The processor 30 effects sampling of output of the empty sensor 29 via the bus 33 and stores the storage area 311 of the memory 31 with the data thereof. In this embodiment, one sampling period is 5 msec. The processor 30 adds [1] to a value of the take-in counter 310 and updates it.

(2) The processor 30 checks whether or not the value of the counter 310 of the memory 31 becomes [4]. If the value of the counter 310 is not [4]. The operation returns to step (1). Whereas if the value of the counter 310 is [4], sample outputs for four times are obtained, and hence the counter 310 is reset. Then, the processor 30 calculates an average value of the sample voltages for 4 times with respect to the storage area 311 and stores the storage area 313 with the average value as a detected value for one time. The operation performed in this way intends to employ the detected value in which the sample values are averaged as an object for comparison because of undergoing an influence of noises if the sample value for one time serves as a detected value.

(3) Next, the processor 30 adds [1] to a value of the detection counter 312 for counting the number of comparisons and updates it. The processor 30 checks whether the detection cycle is the first one or not after being started. If the detection cycle is the first one, a toner empty check is not executed at the first time, and therefore the operation proceeds to step (4). Whereas if the detection cycle is not the first one but the second or subsequent ones, the toner empty check is executed. Accordingly, the processor 30 compares this detected value with the average of the detected values for 80 times during a detection cycle of the previous time with respect to the area 314 of the memory 31. Then, if the detected value is smaller than the average value, the value of the number-of-times counter 315 is incremented by [1], and the operation proceeds to step (4). Whereas if the detected value is the average value or greater, the operation proceeds to step (4).

(4) The processor 30 checks whether or not the detection counter 312 indicates [80] (one detection cycle). The processor 30, if the detection counter 312 does not indicate [80], goes back to step (1) because of one detection cycle still remaining unfinished. On the other hand, when the detection counter 312 indicates [80], one detection cycle is finished. Hence, the processor 30 resets the detection counter 312 of the memory 31. Then, the processor 30 calculates an average of the detected values for 80 times, which are stored in the area 313 of the memory 31.

(5) Next, the processor 30 determines whether or not a number-of-times value n of the number-of-times counter 315 of the memory 31 is smaller than an empty limit value [30]. If the number-of-times value n is smaller than [30], the empty state is not present, and, consequently, the processor 30 checks whether the empty or the near empty is outputted. If the empty or the near empty is not outputted, the operation returns to step (1) in FIG. 11. Whereas if the empty or the near empty is outputted, this is canceled, and the operation goes back to step (1) in FIG. 11.

(6) In step (5), if the number-of-times value n is [30] or larger, the processor 30 determines whether or not the number-of-times value n is [40] or above but smaller than [50]. The processor 30, if the number-of-times value n is [40] or above but smaller than [50], decides that there exists a possibility of being a near empty condition. With this processing, the processor 30 resets the empty counter 317 but increments the near empty counter 316 by [1]. Then, the processor 30 determines whether the near empty counter 316 indicates [3] or not. If the near empty counter 316 does not indicate [3], the operation returns to step (1) because of not being a near empty output state.

Conversely, when deciding that the near empty counter indicates [3], the processor 30 notifies the operation panel 5 of the near empty. With this notification, the operation panel 5 displays the near empty. In this way, even when deciding that the near empty state is present, the notice showing the near empty is not given until this state continues three times. It is therefore possible to prevent a mis-detection of the near empty condition. Note that the notice showing the near empty condition is given, and the operation goes back to step (1).

(7) On the other hand, in step (6), the processor 30, when deciding that the number-of-times value n is [40] or larger but smaller than [50], decides that there exists a possibility of being empty. Then, the processor 30, first, resets the near empty counter 316 of the memory 31. Next, the processor 30 determines whether or not the number-of-times value n is the empty value [50] or greater. If the number-of-times value n is smaller than the empty value [50], the operation returns to step (1). Conversely, the processor 30, when deciding that the number-of-times value n is not less than the empty value [50], increments the empty counter 317 by [1]. Subsequently, the processor 30 determines whether or not the empty counter 317 indicates [3]. If the empty counter 317 does not indicate [3], the operation goes back to step (1) because of not being the empty output state.

Conversely, the processor 30, when deciding that the empty counter 317 indicates [3], notifies the operation panel 5 of the empty condition. With this notification, the operation panel 5 displays the empty signal. In this manner, even when deciding that the empty state is present, the notice showing the empty condition is not given until this state continues three times. Accordingly, it is possible to prevent a mis-detection of the empty signal. Note that the notice showing the empty condition is given, and the operation goes back to step (1).

Next, this operation will be specifically explained with reference to FIGS. 13 through 15.

As illustrated in FIG. 14, a time for one rotation cycle of the agitator 232 is 1.6 sec. Then, a sampling period of the sensor 29 is set to 5 msec, and the detected value is an average of 4-times sampling values of the sensor 29. Subsequently, 80 comparisons are performed during one cycle. The reason why the detected value is the average of the 4-times sampling values of the sensor 29 lies in eliminating the influence of the noises. Further, the reason why one detection cycle is one rotation cycle of the agitator 232 is that a massof toners in the toner hopper 231 move with rotations of the agitator 232, and consequently the quantity of toners existing in the position of the sensor 29 fluctuates. Accordingly, the average of the detected values for one rotation cycle (80 times) of the agitator 232 is set as a comparative reference value. Note that there is not a comparative reference value at the first rotation (the first cycle) of the agitator 232 when started, and, hence, the toner empty detecting operation is not conducted.

Further, as illustrated in FIG. 15, an output voltage of each toner sensor 29 is scattered as shown by a triangle (maximum), a white circle (standard) and a square (minimum) in the figure. As in the present invention, even if the characteristic is scattered in this way, a toner residual quantity is substantially 10 g or under when the detection count number m is X (=30) or larger by monitoring variations in relative level and counting the number of times thereof.

Accordingly, as illustrated in FIG. 13, when the count number n is 30 or larger, the near empty signal occurs. Hence, the toner empty indicator of the operation panel 5 is lit up. Hereat, when replenished with the toners, the toner empty detection takes place once again. Then, as shown in FIG. 13, when the count number n is Z (=30) or under, the toner residual quantity is 30 g or above, and therefore, in this case, the empty is canceled.

On the other hand, when replenished with no toner, and when the detection count number n is Y (=50) or larger, the toner residual quantity is 5 g or smaller. Accordingly, since the empty signal occurs, the toner empty indicator of the operation panel 5 is flashed. Then, the apparatus is set in a not-ready status and then stopped. Hereat, when replenished with the toners, $th_e$ toner empty detection is again effected. Then, as illustrated in FIG. 13, the count number n is Z (=30) or under, the toner residual quantity is 30 g or above, and hence, in this instance, the empty signal is canceled.

In this manner, the toner empty detection is conducted based on the variations in terms of the relative level and on the number of variations. It is therefore possible to accurately detect the empty state without depending on the lever-scatter in the sensor.

FIGS. 16A and 16B are views illustrating another embodiment of the present invention.

FIG. 16A is a front view of the developing unit 23. As depicted in FIG. 16A, a pair of toner sensors 29-1, 29-2 are attached to both ends of the developing unit 23 in the crosswise direction of the sheet. with this arrangement, the toner empty is detected based on outputs of the two sensors 29-1, 29-2.

At this time, as explained earlier, the printer 1 is capable of operating both in the horizontal installation and in the vertical installation. Accordingly, as shown in FIG. 16B, there exists a possibility in which the apparatus is operated while the apparatus is mistakenly tilted when installed. In this case, as shown in FIG. 16B, the toners are concentrated in the crosswise direction of the sheet, with the result that no development can be attained in a half of the sheet. For giving a notice of this fact, when one of the outputs of the two sensors 29-1, 29-2 indicates the toner empty during the toner empty detection, the operation panel 5 displays it and gives an alarm therefor. Accordingly, only when the outputs of the two sensors indicate the toner empty state, the empty signal is outputted.

According to the present invention, the following modifications other than the embodiments discussed above, are practicable. First, the image exposing unit involves the use of the LED optical system but may employ a laser optical system, a liquid crystal shutter optical system, an EL (electro-luminescence) optical system, etc. Second, the latent image forming mechanism has been explained as an electrophotographic mechanism in the embodiments discussed above but is usable as a latent forming mechanism (e.g., an electrostatic recording mechanism or the like) for transferring the toner image. The sheet is not confined to a chart but may use other mediums. Moreover, the photosensitive drum is not limited to the drum-like configuration but may take a belt-like configuration. Third, the image forming apparatus has been explained as a printer but may take other forms such as a copying machine, a facsimile, etc.

The present invention has been discussed by way of the embodiments but may be embodied in a variety of modifications within a range of the gist of the present invention. Those modifications are not eliminated from the appended claims of the present, invention.

As described above, according to the present invention, the output value of the detecting element 29 is compared with the average value during the previous detection cycle, thus detecting the toner empty state at the relative level. It is therefore feasible to eliminate the influence caused by the scatter in terms of the output voltage of the toner detecting element 29. Further, with the construction being taken in this way, the empty signal occurs even in the case of a normal reduction in the toner quantity. Hence, there is counted the number of times when the circuit input value during the predetermined detection period is smaller than the average value. Then, the count value is compared with a predetermined value, and when the count value is larger than the predetermined value, the empty output signal is generated. Accordingly, the empty state of even the toners fluctuating when stirred can be accurately detected.

What is claimed is:

1. A method for detecting a toner empty condition from an output of detecting means for detecting toners in a toner hopper, said method comprising the steps of:

inputting the output of said detecting means a predetermined time intervals;

comparing a detected value relative to an input value with an average value of the detected values during a prior detection cycle;

counting the number of times the detected value is smaller than the average value during an instant detection cycle to obtain a count value;

comparing the count value with a predetermined value; and generating a toner empty output signal when the count value is larger than the predetermined value.

2. The method according to claim 1, wherein said signal generating step includes:

a step of counting the number of times the count value is larger than the predetermined value; and a step of outputting the toner empty signal when the number of counted operations is a specified number of times or above.

3. The method according to claim 1, further comprising a step of canceling the toner empty output signal when the count value is smaller than the predetermined value.

4. The method according to claim 2, further comprising a step of canceling the toner empty output signal when the count value is smaller than the predetermined value.

5. The method according to claim 1, wherein said comparing step includes a step of calculating the detected value by averaging a plurality of successive input values.

6. The method according to claim 2, wherein said comparing step includes a step of calculating the detected value by averaging a plurality of successive input values.

7. The method according to claim 3, wherein said comparing step includes a step of calculating the detected value by averaging a plurality of successive input values.

8. The method according to claim 4, wherein said comparing step includes a step of calculating the detected value by averaging a plurality of successive input values.

9. The method according to claim 1, further comprising a step of calculating the average value during the detection cycle by detecting the number of times that said inputting step has been executed as compared with a predetermined number of executions of said inputting step during the detection cycle.

10. The method according to claim 1, wherein said generating step includes the steps of:

outputting a near empty signal when the count value is larger than a first predetermined value but smaller than a second predetermined value; and outputting the toner empty signal when the count value is larger than the second predetermined value.

11. The method according to claim 10, wherein said near empty signal outputting step includes the steps of:

counting the number of times the count value is larger than the first predetermined value but smaller than the second predetermined value; and outputting the near empty signal when the number of counting operations is the specified number of times or above.

12. The method according to claim 10, wherein said toner empty outputting step includes the steps of:

counting the number of times the count value is larger than the second predetermined value; and outputting the toner empty signal when the number of counting operations is the specified number of times or above.

13. The method according to claims 11, wherein said toner empty outputting step includes the steps of:

counting the number of times the count value is larger than the second predetermined value; and outputting the toner empty signal when the number of counting operations is the specified number of times or above.

14. The method according to claim 12, further comprising a step of resetting the number of counting operations when the count value is larger than the second predetermined value if the count value is larger than the first predetermined value but smaller than the second predetermined value.

15. The method according to claim 13, further comprising a step of resetting the number of counting operations when the count value is larger than the first predetermined value but smaller than the second predetermined value if the count value is larger than the second predetermined value.

16. The method according to claim 14, further comprising a step of resetting the number of counting operations when the count value is larger than the first predeterminedvalue but smaller than the second predetermined value if the count is larger than the second predetermined value.

17. Apparatus for detecting an absence of toners in a toner hopper, said apparatus comprising:

detecting means for detecting the toners in the toner hopper; and a control circuit having means for comparing a detected value relative to an input value when inputting an output of said detecting means for every constant period with an average value of the detected values during a previous detection cycle, means for comparing the count value with a predetermined value, and means for generating an empty output signal when the count value is larger than the predetermined value.

18. The apparatus according to claim 17, wherein said control circuit includes means for counting the number of times the count value is larger than the predetermined value, and means for generating the toner empty output signal when the number of counting operations is a specified number of times or above.

19. The apparatus according to claims 17, wherein said control circuit includes means for cancelling the toner empty output signal when the count value is smaller than the predetermined value.

20. The apparatus according to claim 18, wherein said control circuit includes means for cancelling the toner empty output signal when the count value is smaller than the predetermined value.

21. The apparatus according to claim 17, wherein said control circuit includes means for outputting a near empty signal when the count value is larger than a first predetermined value but smaller than a second predetermined value, and means for outputting the toner empty signal when the count value is larger than the second predetermined value.

22. The apparatus according to claim 21, wherein said control circuit includes means for counting the number of times the count value is larger than the first predetermined value but smaller than the second predetermined value, and means for outputting the near empty signal when the number of counting operations is the specified number of times or above.

23. The apparatus according to claim 21, wherein said control circuit includes means for counting the number of times the count value is larger than the second predetermined value and outputs the toner empty signal when the number of counting operations is the specified number of times or above.

24. The apparatus according to claim 22, wherein said control circuit includes means for counting the number of times the count value is larger than the second predetermined value and outputs the toner empty signal when the number of counting operations is the specified number of times or above.

25. The apparatus according to claim 23, wherein said control circuit includes means for resetting the number of counting operations when the count value is larger than the second predetermined value if the count value is larger than the first predetermined value but smaller than the second predetermined value.

26. The apparatus according to claim 23, wherein said control circuit includes means for resetting the number of counting operations when the count value is larger than the first predetermined value but smaller than the second predetermined value if the count value is larger than the second predetermined value.

27. The apparatus according to claim 24, wherein said control circuit includes means for resetting the number of counting operations when the count value is larger than the first predetermined value but smaller than the second predetermined value if the count value is larger than the second predetermined value.

28. The apparatus according to claim 25, wherein said control circuit includes means for resetting the number of counting operations when the count value is larger than the first predetermined value but smaller than the second predetermined value if the count value is larger than the second predetermined value.

29. The apparatus according to claim 17, wherein said control circuit includes means for setting, as the detection cycle, one rotation cycle of an agitator for agitating the toners in the toner hopper.

* * * * *